US010220411B2

(12) United States Patent
Aronson

(10) Patent No.: US 10,220,411 B2
(45) Date of Patent: Mar. 5, 2019

(54) WOOD TREATMENT METHOD

(71) Applicant: Clayton Thomas Aronson, Prole, IA (US)

(72) Inventor: Clayton Thomas Aronson, Prole, IA (US)

( * ) Notice: Subject to any disclaimer, the term of this patent is extended or adjusted under 35 U.S.C. 154(b) by 0 days.

(21) Appl. No.: 15/987,165

(22) Filed: May 23, 2018

(65) Prior Publication Data

US 2018/0339312 A1 Nov. 29, 2018

Related U.S. Application Data

(60) Provisional application No. 62/510,619, filed on May 24, 2017.

(51) Int. Cl.
*B05D 1/28* (2006.01)
*B05D 1/36* (2006.01)
(Continued)

(52) U.S. Cl.
CPC ..... *B05D 7/06* (2013.01); *B05D 1/28* (2013.01); *B05D 1/36* (2013.01); *B05D 1/38* (2013.01); *B05D 1/40* (2013.01); *B05D 3/002* (2013.01); *B05D 3/007* (2013.01); *B05D 3/105* (2013.01); *B05D 3/107* (2013.01); *B05D 3/108* (2013.01); *B05D 3/12* (2013.01); *B05D 5/061* (2013.01); *B05D 7/08* (2013.01); *B05D 7/26* (2013.01); *B05D 7/534* (2013.01); *B05D 7/536* (2013.01); *B05D 7/574* (2013.01); *B05D 7/576* (2013.01);
(Continued)

(58) Field of Classification Search
CPC ... B05D 1/28; B05D 1/36; B05D 1/38; B05D 1/40; B05D 2203/20; B05D 2350/33; B05D 2350/35; B05D 2350/38; B05D 2350/50; B05D 2501/00; B05D 2502/00; B05D 2503/00; B05D 2508/00; B05D 2520/00; B05D 2520/05; B05D 3/002; B05D 3/007; B05D 3/105; B05D 3/107; B05D 3/108; B05D 3/12; B05D 5/061; B05D 7/06; B05D 7/08; B05D 7/26; B05D 7/534; B05D 7/536; B05D 7/574; B05D 7/576
See application file for complete search history.

(56) References Cited

U.S. PATENT DOCUMENTS 2,345,940 A * 4/1944 Lehman ..... B05C 9/022 427/202
3,498,001 A * 3/1970 MacDonald ..... A47B 95/00 428/317.1
(Continued)

FOREIGN PATENT DOCUMENTS

CN 104260503 A * 1/2015
GB 2369148 A * 5/2002 ..... B44C 1/221

*Primary Examiner* — William P Fletcher, III
(74) *Attorney, Agent, or Firm* — Christopher A. Proskey; BrownWinick Law Firm

(57) ABSTRACT

Disclosed is a method for treating a grained material. A nonlimiting example of the method includes the operations of providing a workpiece having grains, exasperating a surface of the workpiece to open the grains, applying at least one coat of a base paint to the exasperated surface, applying at least one layer of clear coat on the base paint, applying at least one of a glaze and a paint on the clear coat, and surface treating to reveal grains of the workpiece. Disclosed also are items of furniture and sheet materials treated by the aforementioned process.

16 Claims, 22 Drawing Sheets

(51) Int. Cl.

| | |
|---|---|
| ***B05D 1/38*** | (2006.01) |
| ***B05D 1/40*** | (2006.01) |
| ***B05D 3/00*** | (2006.01) |
| ***B05D 3/10*** | (2006.01) |
| ***B05D 3/12*** | (2006.01) |
| ***B05D 5/06*** | (2006.01) |
| ***B05D 7/00*** | (2006.01) |
| ***B05D 7/06*** | (2006.01) |
| ***B05D 7/08*** | (2006.01) |
| ***B05D 7/26*** | (2006.01) |

(52) U.S. Cl.

CPC ..... *B05D 2203/20* (2013.01); *B05D 2350/33* (2013.01); *B05D 2350/35* (2013.01); *B05D 2350/50* (2013.01); *B05D 2501/00* (2013.01); *B05D 2502/00* (2013.01); *B05D 2503/00* (2013.01); *B05D 2508/00* (2013.01); *B05D 2520/00* (2013.01); *B05D 2520/05* (2013.01)

(56) References Cited

U.S. PATENT DOCUMENTS 4,366,282 A * 12/1982 Zima ..... C09D 133/12
523/408
5,286,778 A * 2/1994 Dean ..... C09D 15/00
428/537.1
5,676,899 A * 10/1997 Mrozinski ..... B29C 33/40
264/226

* cited by examiner

Start with a plain piece of wood with grains

Exasperate grains through a mechanical process

Apply Base Coat

Apply Clear Coat

Add glaze or second coat of paint

Sand off glaze – sand into clear coats, leaving only glaze in the recessed grains.

Add clear coat

Example of Waterfall Edge.

Example of an Accent Grain – a grain colored differently than the others.

Example of an Accent Grain – a grain colored differently than the others.

Example of bench with Treated Upper and Lower and Outer and Inner surfaces treated with the surface treatment process presented herein and a Live Edge on the front and back edges of the bench.

WOOD TREATMENT METHOD

CROSS REFERENCE TO RELATED APPLICATIONS

This application claims benefit from U.S. Provisional Application No. 62/510,619 which was filed on May 24, 2017, the entirety of which is incorporated herein fully by reference.

BACKGROUND

1. Field

Example embodiments relate to a method for treating a grained material, for example, a piece of wood, or a piece of furniture made of wood, plywood or the like. Example embodiments also relate to various manufacturing methods and items, for example, furniture, produced by the manufacturing methods.

2. Description of the Related Art

Methods for treating wood are old in the art and date back to the time of antiquities. Some methods are directed to producing a wood having a high aesthetic appeal, such as staining, painting or the like. However, many of these methods are expensive and time consuming and many of these methods produce mundane or unappealing or uninteresting results. As such, there is a need for a new method of treating wood as well as need for new methods of manufacturing items, for example, sheet material and/or furniture, made from the treated wood.

SUMMARY

Example embodiments relate to a method for treating a grained material, for example, wood. Example embodiments also relate to various manufacturing methods and items, for example, sheet material and/or furniture, produced by the manufacturing methods.

Disclosed is a method for treating a grained material. In a nonlimiting example of the method, the method includes the operations of providing a workpiece having grains, exasperating a surface of the workpiece to open the grains, applying at least one coat of a base paint to the exasperated surface, applying at least one layer of clear coat on the base paint, applying at least one of a glaze and a paint on the clear coat, and surface treating to reveal the grains of the workpiece.

Disclosed also is an a nonlimiting example of an item of furniture which includes a grained workpiece having a first coat of paint, at least one clear coat on the first coat of paint, one of a glaze and a second coat of paint on the at least one clear coat which is on the first coat of paint, and at least one layer of clear coat on the one of the glaze and the second coat of paint.

Disclosed also is a nonlimiting example of a board or sheet of material which includes a first coat of paint on the board or grained sheet, at least one clear coat on the first coat of paint, one of a glaze and a second coat of paint on the at least one clear coat on the first coat of paint, and at least one layer of clear coat on the one of the glaze and the second coat of paint.

BRIEF DESCRIPTION OF THE DRAWINGS

Example embodiments are described in detail below with reference to the attached drawing figures, wherein.

DETAILED DESCRIPTION

Figure 1:
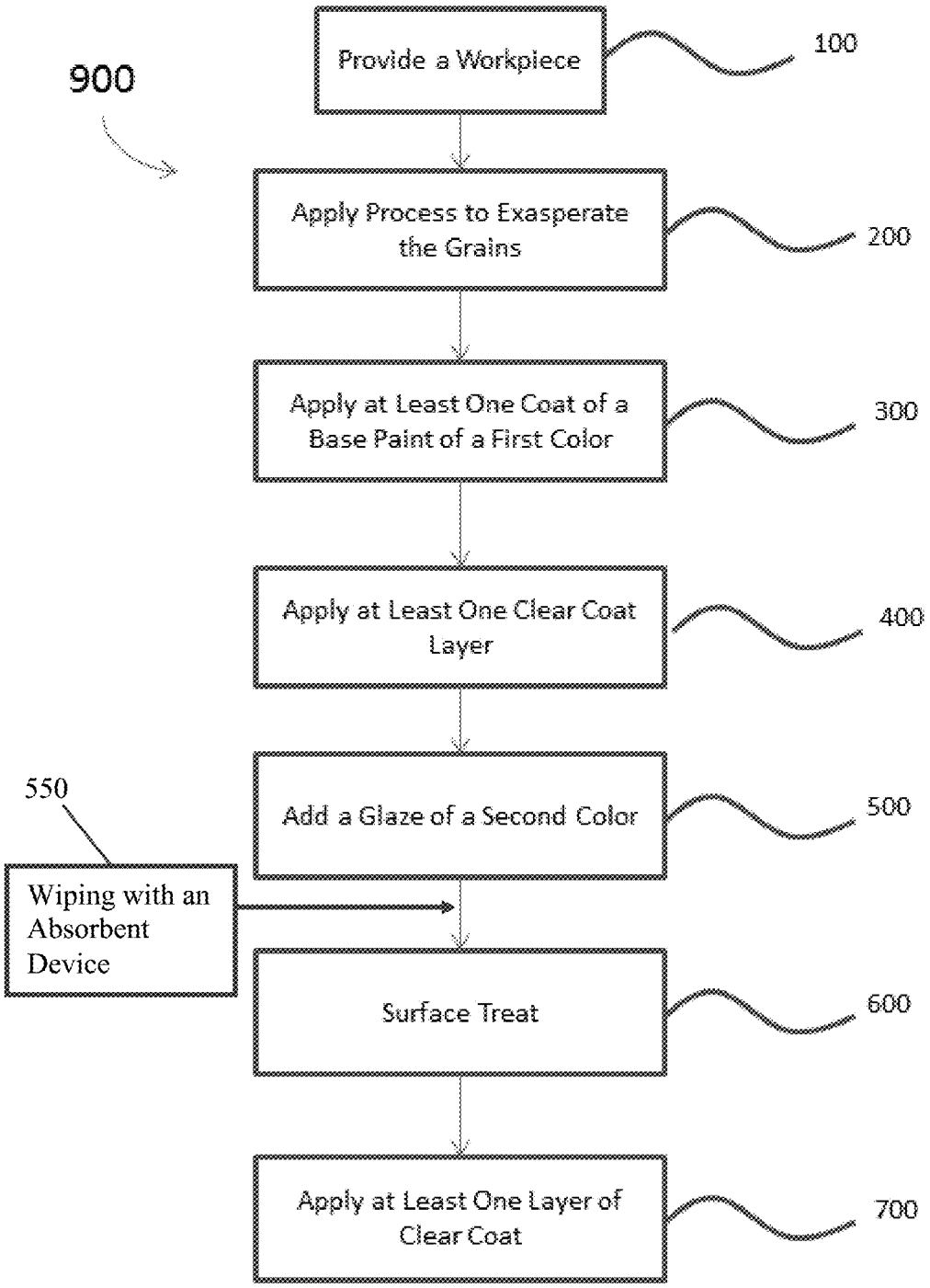
FIG. 1 is a flowchart of a method for treating a grained material in accordance with example embodiments.

Example embodiments will now be described more fully with reference to the accompanying drawings. Example embodiments are not intended to limit the disclosure since the disclosure may be embodied in different forms. Rather, example embodiments are provided so that this disclosure will be thorough and complete, and will fully convey the scope of the disclosure to those skilled in the art. In the drawings, the sizes of components may be exaggerated for clarity.

In this application, when a first element is described as being "on" or "connected to" a second element, the first element may be directly on or directly connected to the second element or may be on or connected to an intervening element that may be present between the first element and the second element. When a first element is described as being "directly on" or "directly connected to" a second element, there are no intervening elements. In this application, the term "and/or" includes any and all combinations of one or more of the associated listed items.

In this application, spatially relative terms merely describe one element's relationship to another. The spatially relative terms are intended to encompass different orientations of the structure. For example, if a first element of a structure is described as being "above" a second element, the term "above" is not meant to limit the disclosure since, if the structure is turned over, the first element would be "beneath" the second element. As such, use of the term "above" is intended to encompass the terms "above" and "below". The structure may be otherwise oriented (rotated 90 degrees or at other orientations) and the spatially relative descriptors used herein interpreted accordingly.

Example embodiments are illustrated by way of ideal schematic views. However, example embodiments are not intended to be limited by the ideal schematic views since example embodiments may be modified in accordance with manufacturing technologies and/or tolerances.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Example embodiments relate to a method for treating a grained material, for example, wood. Example embodiments also relate to various manufacturing methods and items, for example, furniture, produced by the manufacturing methods.

As is presented herein, a surface treatment method is presented herein that provides a new, useful and non-obvious visual appearance. This method is to be used with any grained material, such as a solid piece of wood, a piece of laminated material, such as plywood or the like, a piece of furniture formed out of a plurality of pieces of wood, or any other piece of material having grains. As such, the terms such as wood, piece of grained material, workpiece, laminated material, grained workpiece, or the like are meant to be non-limiting and are intended to be interchangeable, unless specifically identified or meant otherwise, as the method is applicable to any grained material or workpiece.

Also, the term "clear coat" is used here. While this term includes the word "clear" this term is meant to be non-limiting, and does not require absolute clarity. Instead, this term is meant to include any coating that is clear, transparent, translucent or the like, as opposed to pa. That is, the term "clear coat" is meant to include any layer or surface treatment that allows the underlying layer(s) to be seen through the coating and may include any varnish, resin, shellac, alkyd, spar varnish, drying oil, polyurethane, lacquer, acrylic or the like, unless specifically limited or meant otherwise.

FIG. 1 is a view of a method 900 for treating a grained workpiece 1000. In the nonlimiting example of FIG. 1, the method 900 is illustrated as comprising seven (7) steps, however, the number of method steps are exemplary in nature and it is understood the method may actually comprise more or less steps; in addition, the steps may be changed, and/or the sequence of the steps may be changed. FIGS. 2A-2H illustrate the method applied to a grained workpiece 1000, such as a piece of wood, a piece of laminated material (such as plywood) or the like, in accordance with a nonlimiting example of the disclosure. FIGS. 4A-4G are photographs of a workpiece being treated by the method of FIG. 1

Figure 2A:
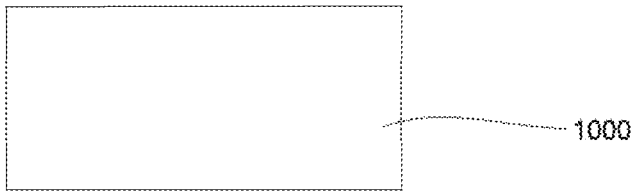
FIG. 2A a view of a grained workpiece in accordance with example embodiments.
Figure 4A:
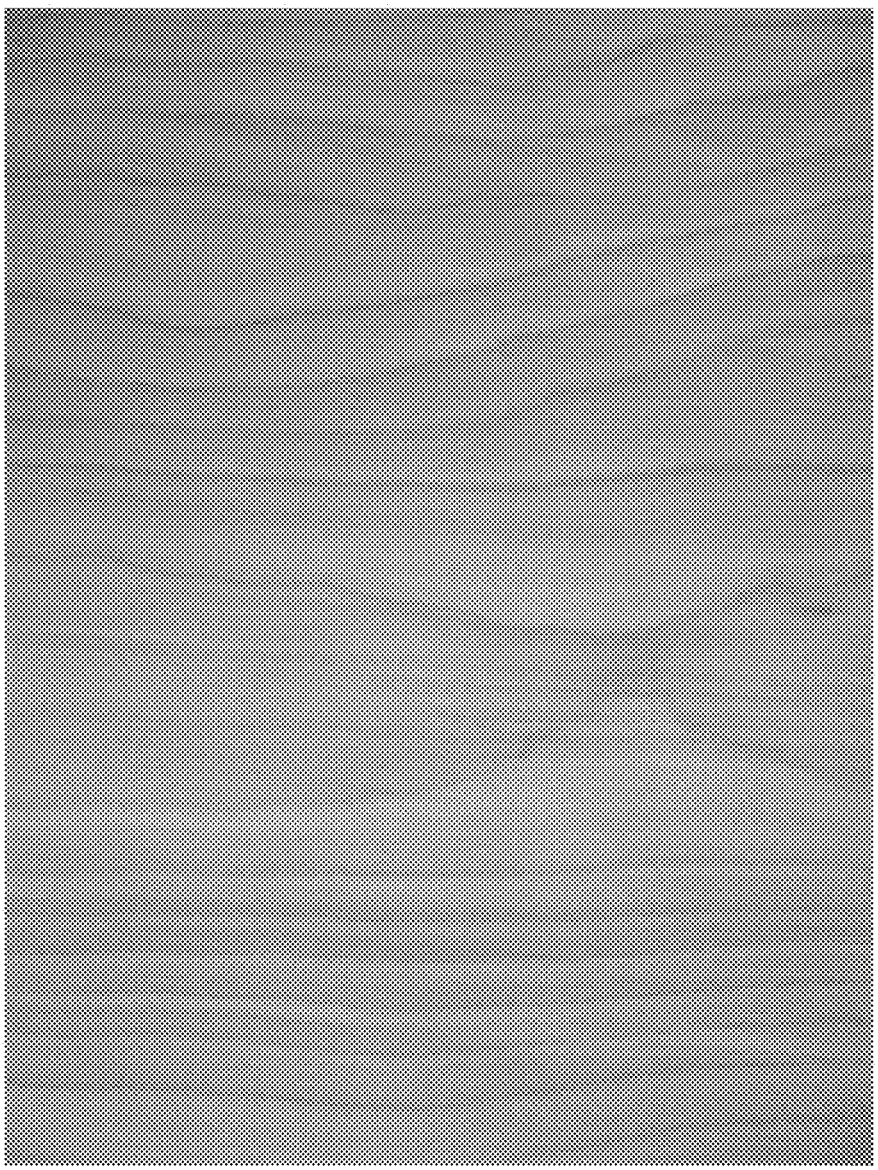
FIG. 4A a view of a photograph of a grained workpiece in accordance with example embodiments.

STEP 100—PROVIDE WORKPIECE: As shown in FIG. 1, the method 900 for treating a grained workpiece 1000 may begin by providing a grained work piece 1000 (see step 100). By way of example, the grained work piece 1000 may be grained wood, for example, a piece of solid wood, plywood, or any other fabricated/laminated piece of wood having a grain. FIG. 2A illustrates a schematic example of a grained workpiece 1000 and FIG. 4A is a photograph showing a grained workpiece (e.g. a plain piece of wood with grains). It is understood that FIG. 2A illustrates an ideal schematic of a grained workpiece 1000 and that various other shapes and sizes may be treated by the method of FIG. 1. It is also understood that FIG. 4A merely illustrates an example of a grained workpiece and is not intended to limit the disclosure. As such, the example workpiece 1000 illustrated in FIGS. 2A and 4A are not intended to limit the disclosure.

STEP 200—EXASPERATE GRAINS: In the method 900 for treating a grained workpiece 1000 a process may be applied to the grained workpiece 1000 to exasperate the grains thereof (see step 200). By way of example only, the process may be a mechanical process, such as, but not limited to, sandblasting and/or wire brushing, or may be a chemical process. Any other mechanical or chemical process that exasperates the grains of wood is hereby contemplated for use. Regardless of the particular process used, the purpose of the process is to open the grains of the workpiece 1000 and to increase the difference between the grains of workpiece 1000 and the non-grain portions of the workpiece 1000.

The term "grain" refers to the orientation of wood-cell fibers within workpiece 1000. The grain is formed of porous wood cells or pours that are typically arranged in bands called rays. The size and distribution of grains or pores may vary from fine-grained to course-grained. Workpieces 1000 with large cells, many pores, and broad rays tend to be considered coarse-grained. As examples, oak and ash woods tend to be considered coarse-grained. Workpieces 1000 with smaller cells, fewer pores, and thin rays tend to be considered fine-grained. As examples, sycamore and maple woods tend to be considered fine-grained. Workpieces 1000 with medium sized cells, medium sized pores, and medium rays tend to be considered medium-grained. As examples, walnut and mahogany woods tend to be considered medium-grained. For purposes of the discussion herein, the grained portion of workpiece 1000 includes the portions of bands or rays of the grain that include pores therein. This portion of the grain tends to be darker in color. For purposes of the discussion herein, the non-grained portion of workpiece 1000 includes the portions of bands or rays of the grain that do not include the pores, or have a lower density of pores therein. This portion of the grain tends to be lighter in color.

Figure 2B:
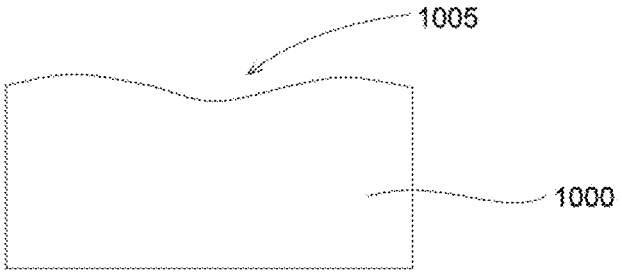
FIG. 2B is a view of a grained workpiece having an exasperated surface in accordance with example embodiments.
Figure 4B:
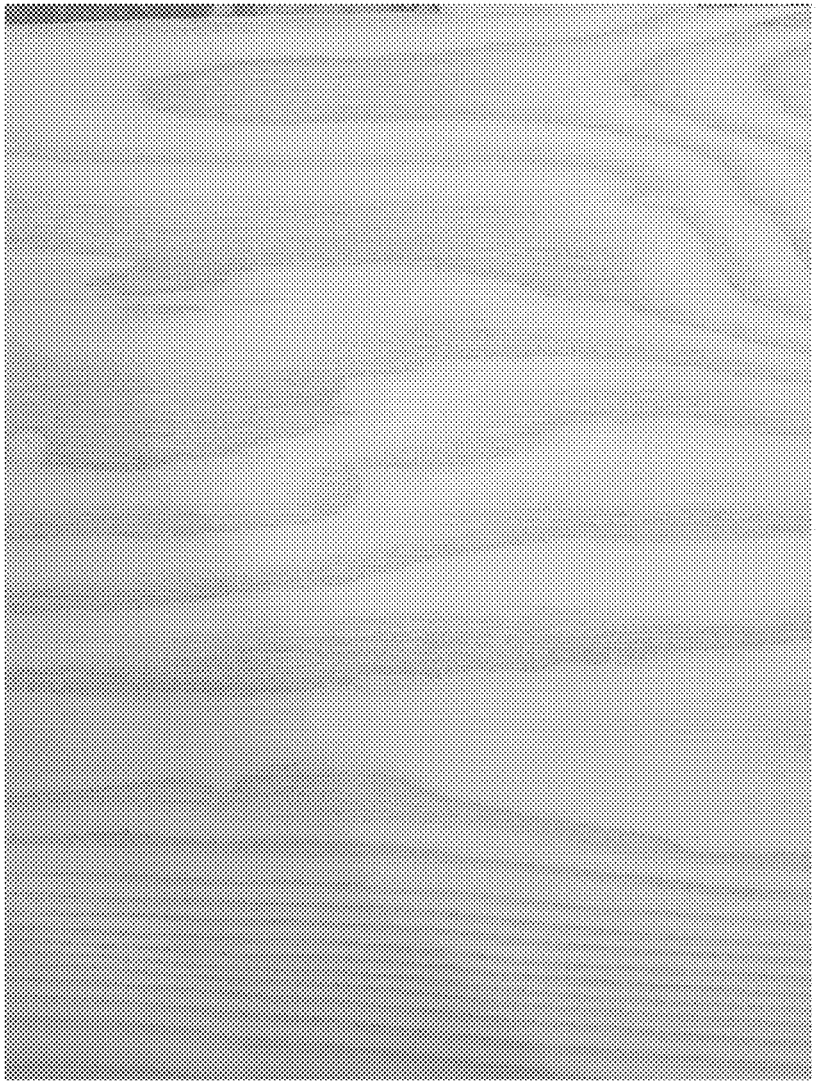
FIG. 4B is a photograph of the grained workpiece having an exasperated surface in accordance with example embodiments.

FIG. 2A shows a workpiece 100 prior to the exasperation process 200. More specifically, FIG. 2A shows a workpiece 1000 having a generally flat upper surface. FIG. 2B illustrates the workpiece 1000 having an upper surface 1005 treated by the aforementioned exasperation process 200. More specifically, as a demonstrative example, FIG. 2B shows the grains exasperated, or said another way, the upper surface has a recess where the grains of the workpiece 100 intersect the upper surface. This exasperated recess is due to the exasperation process 200 which causes the recesses or openings that intersect the upper surface, or any treated surface for that matter, to be greater than it would have otherwise been. FIG. 4B is a photograph illustrating the wood of workpiece 100 of FIG. 2A having a surface exasperated by a mechanical process. The exasperation process 200 increases the contrast between the grained portion of workpiece 1000 and the non-grained portion of the workpiece 1000. Due to the material property differences between the grained portion and the non-grained portion of the workpiece 1000, the exasperation process 200 has a tendency to remove portions of material in the grained portion of the workpiece 1000, and/or open the pores of the grained portion of the workpiece 1000, while having a tendency to not affect, or not affect as much, the non-grained portions of workpiece 1000 in the same manner. This causes an increase in the texture or surface contours of the grained portion of the workpiece 1000 while leaving the non-grained portion of the workpiece 1000 relatively flat and/or smooth. As such, the exasperation process 200 causes a non-grained portion of workpiece 1000 to remain relatively flat and/or smooth while increasing the surface texture or contours or recesses of the grained portion of workpiece 1000 into the treated surface. This is in-part due to the removal of softer or more-easily removed portions of the pores of the grained portion of workpiece 1000 while leaving the harder or less-easily removed portions of the grained portion of workpiece 1000.

As an example, when sandblasting is the process used during the exasperation process 200, as the sand is blown onto the workpiece 1000, the sand has a tendency to remove and/or open portions of the pores of the grained portion of workpiece 1000 while leaving the non-grained portions of the workpiece 1000 relatively intact and smooth. This has the effect of creating greater texture or surface contours in the grained portion of the workpiece 1000 as compared to the non-grained portions. Similarly, as another example, when wire brushing is the process used during the exasperation process 200, as the wires of the brush engage the workpiece 1000, the wires have a tendency to remove and/or open portions of the pores of the grained portion of workpiece 1000 while leaving the non-grained portions of the workpiece 1000 relatively intact and smooth. This has the effect of creating greater texture or surface contours in the grained portion of the workpiece 1000 as compared to the non-grained portions. Similarly, as another example, when a chemical process is used during the exasperation process 200, as the chemicals engage the workpiece 1000, the chemicals have a tendency to remove and/or open portions of the pores of the grained portion of workpiece 1000 while leaving the non-grained portions of the workpiece 1000 relatively intact and smooth. This has the effect of creating greater texture or surface contours in the grained portion of the workpiece 1000 as compared to the non-grained portions. Notably, in one arrangement, when wire brushing is used as the exasperation process 200, care is taken to ensure the motion of wire brushing aligns with the direction or flow of the grains in workpiece 1000. This is as opposed to wire brushing perpendicular or across the direction of flow of the grains in workpiece 1000. This directionality helps to optimally open the grains appropriately while not overly damaging the surface of the workpiece 1000.

Figure 2C:
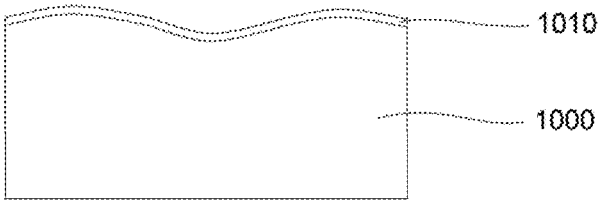
FIG. 2C is a view of the grained workpiece having the exasperated surface with a base paint applied thereto in accordance with example embodiments.
Figure 3A:
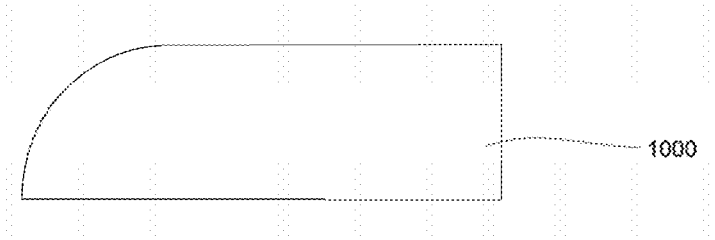
FIG. 3A a view of a grained workpiece in accordance with example embodiments.
Figure 3B:
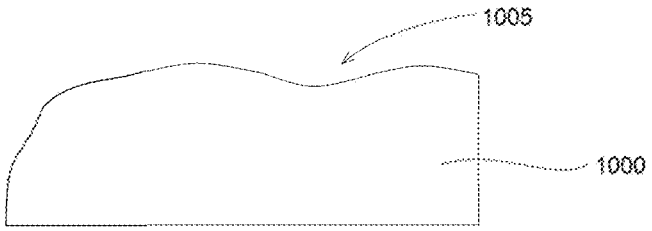
FIG. 3B is a view of a grained workpiece having an exasperated surface in accordance with example embodiments.
Figure 3C:
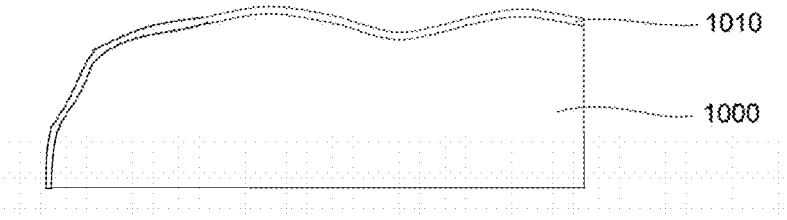
FIG. 3C is a view of the grained workpiece having the exasperated surface with a base paint applied thereto in accordance with example embodiments.
Figure 3D:
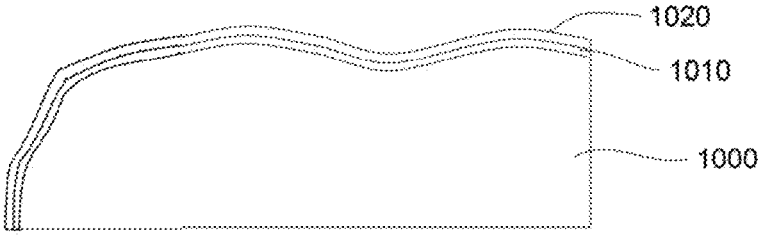
FIG. 3D is a view of the grained workpiece having at least one clear coat applied thereto in accordance with example embodiments.
Figure 3E:
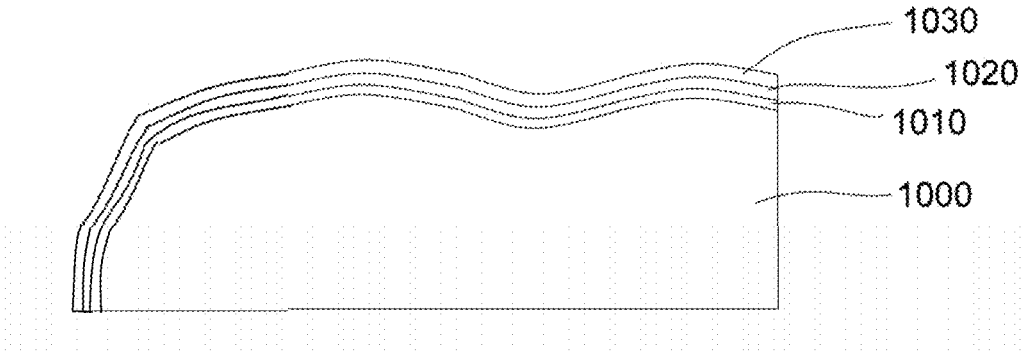
FIG. 3E is a view of the grained workpiece with a glaze or a paint applied thereto in accordance with example embodiments.
Figure 3F:
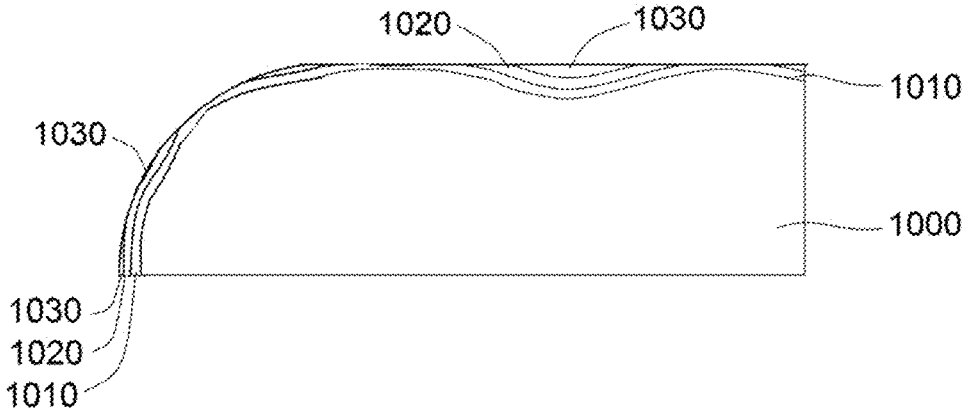
FIG. 3F is a view of the grained workpiece after a surface treatment in which the glaze or paint is left only in the recessed grains or recessed surface contours accordance with example embodiments.
Figure 3G:
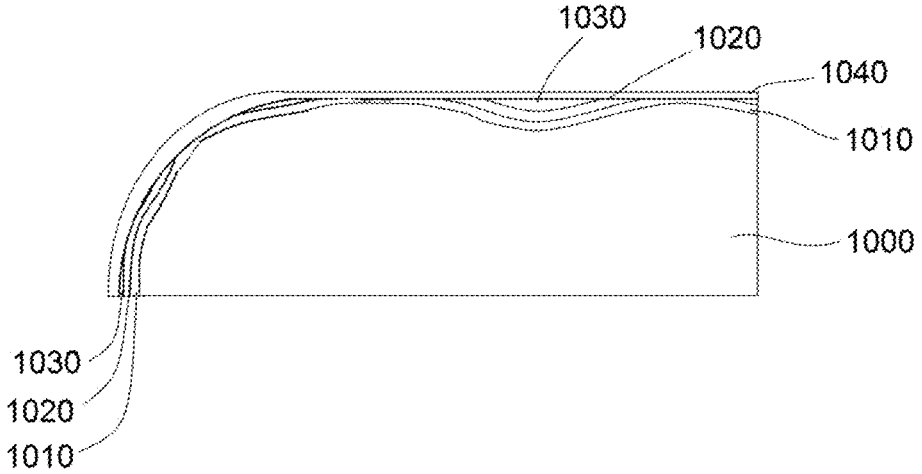
FIG. 3G is a view of the grained workpiece with at least one clear coat thereon in accordance with example embodiments.

STEP 300—BASE PAINT: After the grains of the grained workpiece 1000 are exasperated at least one coat of a base paint 1010 may be applied to the exasperated surface 1005 (see step 300). FIG. 2C illustrates the workpiece 1000 having at least one coat of base paint 1010 applied thereto and FIG. 3C is a photograph of a workpiece having an exasperated surface with at least one coat of base paint thereon. The base paint 1010 may be of a first color, several colors, or may even be transparent or opaque. For example, a user may use a solid color which may be applied as a water based or oil based paint. As another example, the base paint 1010 may be applied as strips of paint each having a different color. As yet another example, the base paint 1010 may be applied as a clear coat to preserve the natural color of the workpiece 1000 or as a clear coat placed over a stain to enhance and preserve the natural color of the work piece. In example embodiments, the base paint 1010 may be applied in a conventional manner. For example, the base paint 1010 may be rolled onto surface 1005 of the workpiece 1000 or sprayed onto surface 1005 with a gravity feeder. Alternatively, base paint 1010 may be applied by any other manner, method or means.

In example embodiments, the base paint 1010 may actually be applied as several coats of base paint 1010. In other words, in operation 300, the base paint 1010 may be applied as a plurality of relatively thin layers, where each layer is allowed to dry before applying the next layer. In addition, operation 300 may further include sanding operations between some or all the applied layers of base paint 1010, after they have been allowed to dry. For example, a first coat of base paint 1010 may be applied to the exasperated surface 1005 of grained workpiece 1000 and allowed to dry. The dried base paint 1010 may be lightly sanded to smooth out the painted surface to avoid any paint-induced pooling, to knock down any bumps, to remove any clumps or other contaminants contained in the paint, and/or to help provide a flatter and smoother upper surface to the workpiece 1000. After the first coat of base paint 1010 is smoothed out by sanding, the upper surface may be cleaned by wiping with a moist cloth to remove any dust and debris from sanding, and a second coat of base paint 1010 may be applied to the sanded and cleaned and dried first coat of base paint 1010. The second coat of base paint 1010 may also then be allowed to dry and then smoothed, for example, by sanding, to avoid paint-induced pooling then wiped clean with a moist cloth and allowed to dry. This process may be performed for a third layer of base paint 1010. This process may be repeated until a desired number of coats of base paint 1010 have been applied to the grained workpiece 1000. It has been tested with success that using a high-grit sand paper (such as 320 or the like or higher), however, any other sanding medium is hereby contemplated for use, such as a scrub pad, steel wool, or the like, and is used in conjunction with a flat sanding surface, such as a sanding block, may be usable to lightly sand the painted base paint layer/layers 1010 to achieve the desired results. The sanding may be accomplished by hand sanding, orbital sanding, or any other sanding process. In one nonlimiting example embodiment, three layers of base paint 1010 have been tested with success and may be preferred, however, it is also contemplated that two coats or more than three coats may be applied to the exasperated surface 1005. By the iterative process of sanding between each layer of base paint 1010 it has been found that a smoother surface is provided that reduces undesired surface variations that are not in the grained portion of the workpiece 1000. In latter steps of the process, these undesired surface variations have the tendency to attract and hold paint, like the exasperated grain structure, which is undesirable.

Figure 4C:
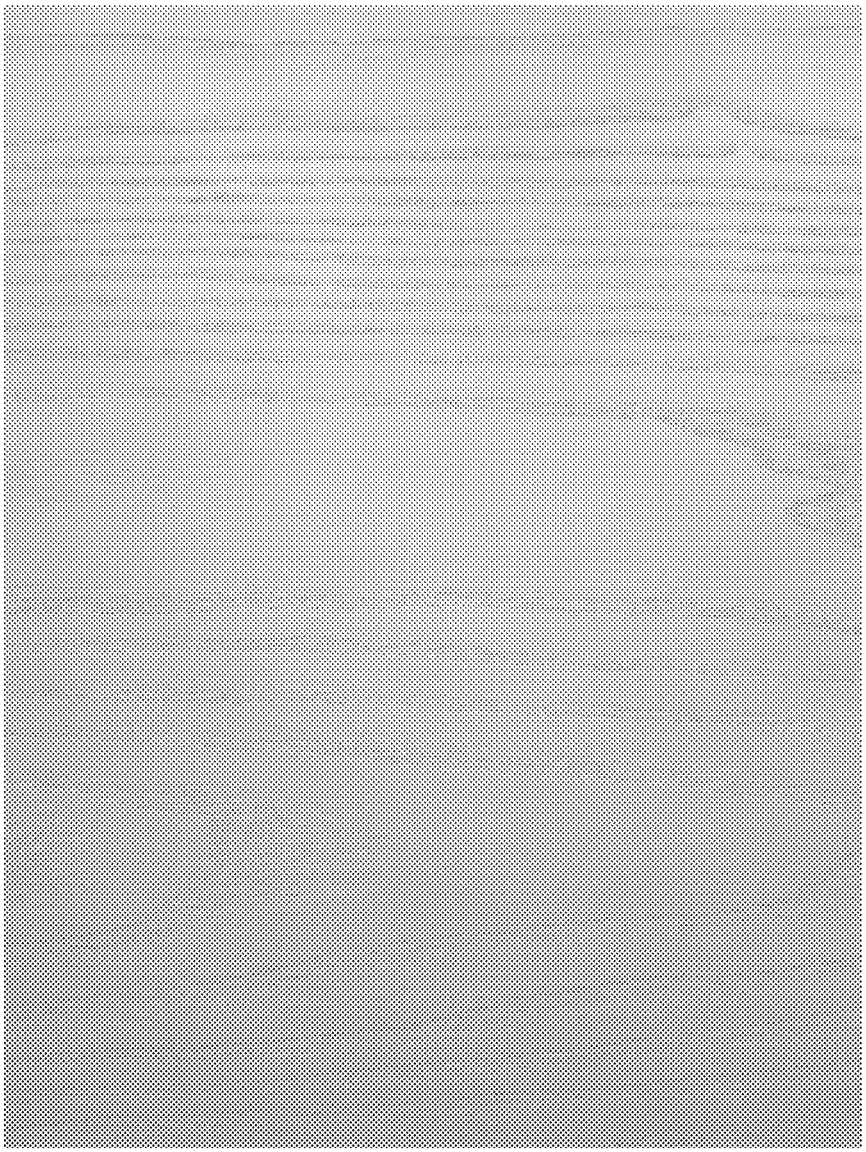
FIG. 4C is a photograph of the grained workpiece having the exasperated surface with a base paint applied thereto in accordance with example embodiments.

As one demonstrative example, FIG. 2C shows a demonstrative of a workpiece 1000 with base paint layer 1010 thereon. As another example, FIG. 4C shows a picture of a workpiece 1000 with a tan colored base paint layer 1010 thereon.

Figure 2D:
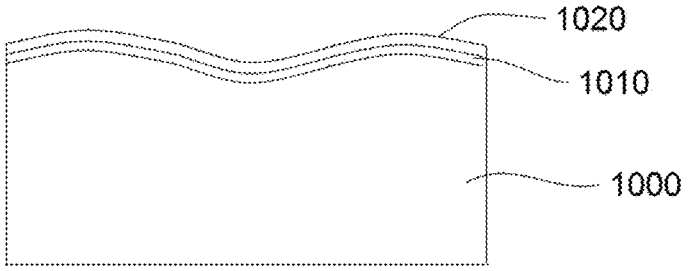
FIG. 2D is a view of the grained workpiece having at least one clear coat applied thereto in accordance with example embodiments.

STEP 400—CLEAR COAT: After the grains are exasperated and at least one coat of a base paint 1010 has been applied to the exasperated surface 1005, and in one arrangement sanded after drying (and/or sanded after drying between layers of the base paint 1010) at least one clear coat layer 1020 may be applied to the base paint 1010 as shown in FIG. 2D and illustrated as operation 400 of FIG. 1. In this operation, the clear coat layer 1020 may be a water-based or oil based varnish. While the term "clear" is use in association with clear coat layer 1020, it is not required that the clear coat layer 1020 be clear. In contrast, the clear coat layer 1020, while in many cases is clear or nearly clear, may be of any level of translucent from clear to opaque and may be any color.

Figure 4D:
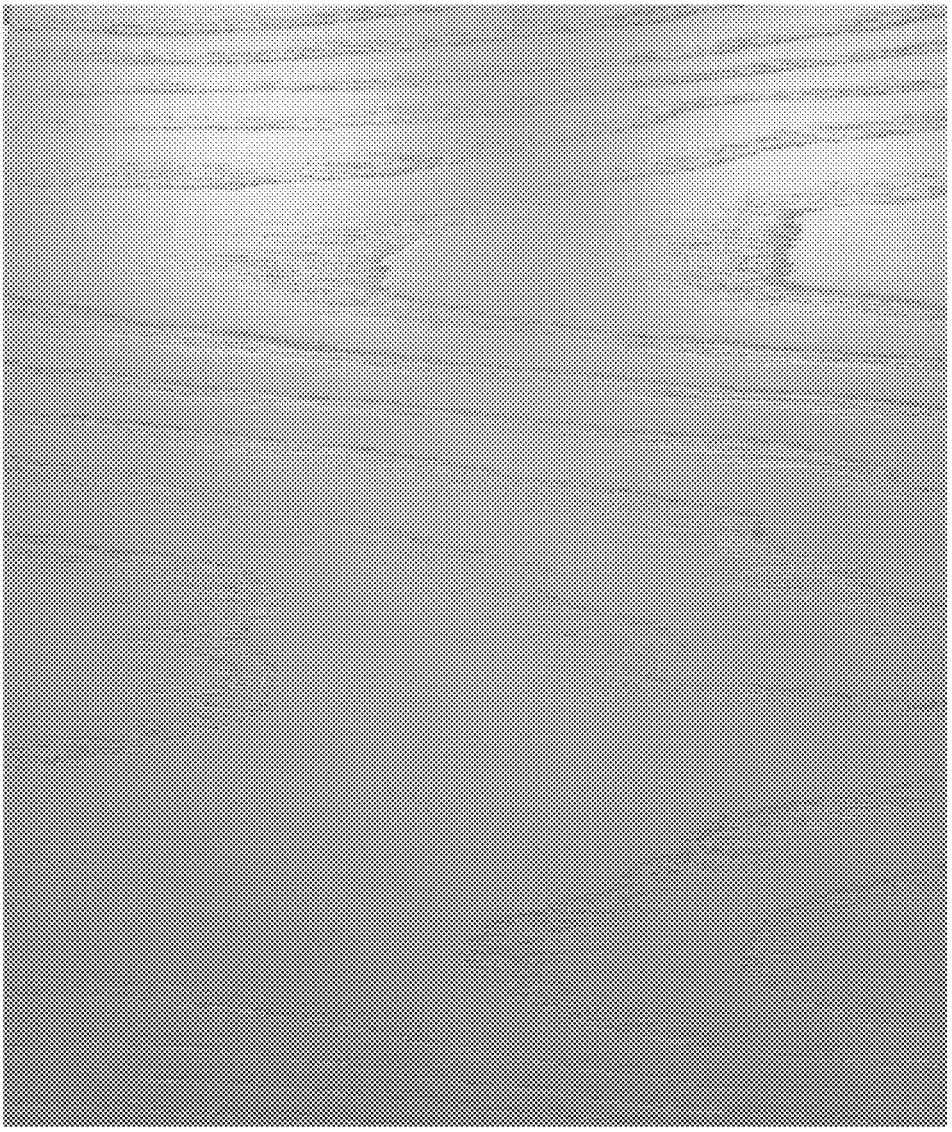
FIG. 4D is a photograph of the grained workpiece having at least one clear coat applied over the base paint in accordance with example embodiments.

The clear coat layer 1020 may be applied, dried, sanded and wiped in an identical or similar manner to that described herein with respect to base paint 1010 layer and reference is made to those portions of this application. More specifically, in one arrangement, the clear coat layer 1020 may be applied in a conventional manner, for example, by spraying or rolling. Alternatively, clear coat layer 1020 may be applied by any other manner, method or means. As in operation 300, operation 400 may include an additional step of sanding the clear coat layer 1020, after it has dried, to avoid any coating-induced pooling to knock down any bumps, to remove any clumps or other contaminants contained in the clear coat, and/or to help provide a flatter and smoother upper surface to the workpiece 1000, and then wiping the surface with a damp cloth after sanding to remove any debris and contaminants and dust. In this nonlimiting example, a high-grit sand paper (320) in conjunction with a flat sanding surface, such as a sanding block, may be usable to lightly sand the clear coat layer 1020. The sanding may be accomplished by hand sanding, orbital sanding, or any other sanding process or any other process. FIG. 4D is a photo a workpiece corresponding to the workpiece 1000 of FIG. 2D having a clear coat thereon.

In example embodiments, the clear coat layer 1020 may actually be applied as several clear coats. In other words, in operation 400, the clear coat 1020 may be applied as a plurality of relatively thin clear coats. Furthermore, operation 400 may further include additional sanding operations associated with and/or between the applied clear coats 1020. For example, a first clear coat 1020 may be applied to the base paint 1010 and allowed to dry. The dried clear coat 1020 may be lightly sanded to smooth out the surface and rid the clear coat 1020 of aberrations to avoid any pooling and then is wiped clean with a damp cloth and allowed to dry. After the first layer of clear coat 1020 is smoothed out and wiped clean, a second layer clear coat 1020 may be applied to the first layer of clear coat 1020 and the second clear coat may also be allowed to dry and then smoothed, for example, by sanding, to avoid any pooling and then is wiped clean with a damp cloth and allowed to dry. This process may be repeated until a desired number of clear coats have been applied to the base paint 1010. It has been found that using a high-grit sand paper (320) in conjunction with a flat sanding surface, such as a sanding block, may be usable to lightly sand the clear coat layer/layers 1020 to achieve the desired results. The sanding may be accomplished by hand sanding, orbital sanding, or any other sanding process. In one nonlimiting example embodiment, two layers of clear coat 1020 have been tested with success and may be preferred, however, it is also contemplated that one coats or more than two coats may be applied to the base paint 1010 layer to achieve desired results.

As one demonstrative example, FIG. 2D shows a demonstrative of a workpiece 1000 with base paint layer 1010 with a layer of clear coat 1020 thereon. As another example, FIG. 4D shows a picture of a workpiece 1000 with a tan colored base paint layer 1010 with a layer of clear coat 1020 thereon.

STEP 500—GLAZE: After application of the clear coat layer 1020, at least one layer of glaze or a second paint 1030 may be applied on the clear coat layer 1020 (see operation 500). The glaze or second paint 1030 may or may not be of a second color (which is different than the first color of the base paint layer 1010) and, in some embodiments, may actually be applied as multiple colors. For example, if the base paint 1010 applied in operation 300 was yellow the glaze or second paint 1030 applied in operation 500 may not be yellow to provide contrast between the base paint 1020 and the glaze or second paint 1030 (however in other embodiments the glaze or second paint may be yellow or may be transparent). For example, the glaze or second paint 1030 applied in operation 500 may be red or black or any other color. The glaze or paint 1030 may be applied in a conventional manner. For example, the glaze or paint 1030 applied in operation 500 may be squeegeed on, rolled on, or sprayed onto the clear coat layer 1020. In this example it may be preferable to work the glaze or paint 1030 into the grains through a mechanical process such as squeegeeing, wiping, rubbing, brushing, rolling or the like. It has been tested with success that one nonlimiting method of accomplishing this goal uses a soft-edged squeegee. The purpose of taking extra care to work the glaze or second paint 1030 into the surface of workpiece 1000 is to ensure that the glaze fully fills the recesses, depressions and other aberrations or features in the surface of the workpiece 1000 formed by the exasperated grains of the workpiece 1000. Working the glaze or second paint 1030 by a mechanical process may be accomplished by wiping the glaze or second paint 1030 back and forth one or more times with a roller, paint brush, squeegee, or other any other mechanical process or combination thereof. In one arrangement, the glaze or second paint 1030 is sprayed on with a spraying process and then is worked in with a mechanical process such as brushing, rolling, squeegeeing or the like. The purpose of working the glaze or second paint 1030 into the recesses, depressions and other aberrations or features in the surface of the workpiece 1000 is to ensure that some of the glaze or second paint 1030 remains in the recesses, depressions and other aberrations or features in the surface of the workpiece 1000 after the workpiece 1030 is sanded after the glaze or second paint 1030 dries.

Figure 8:
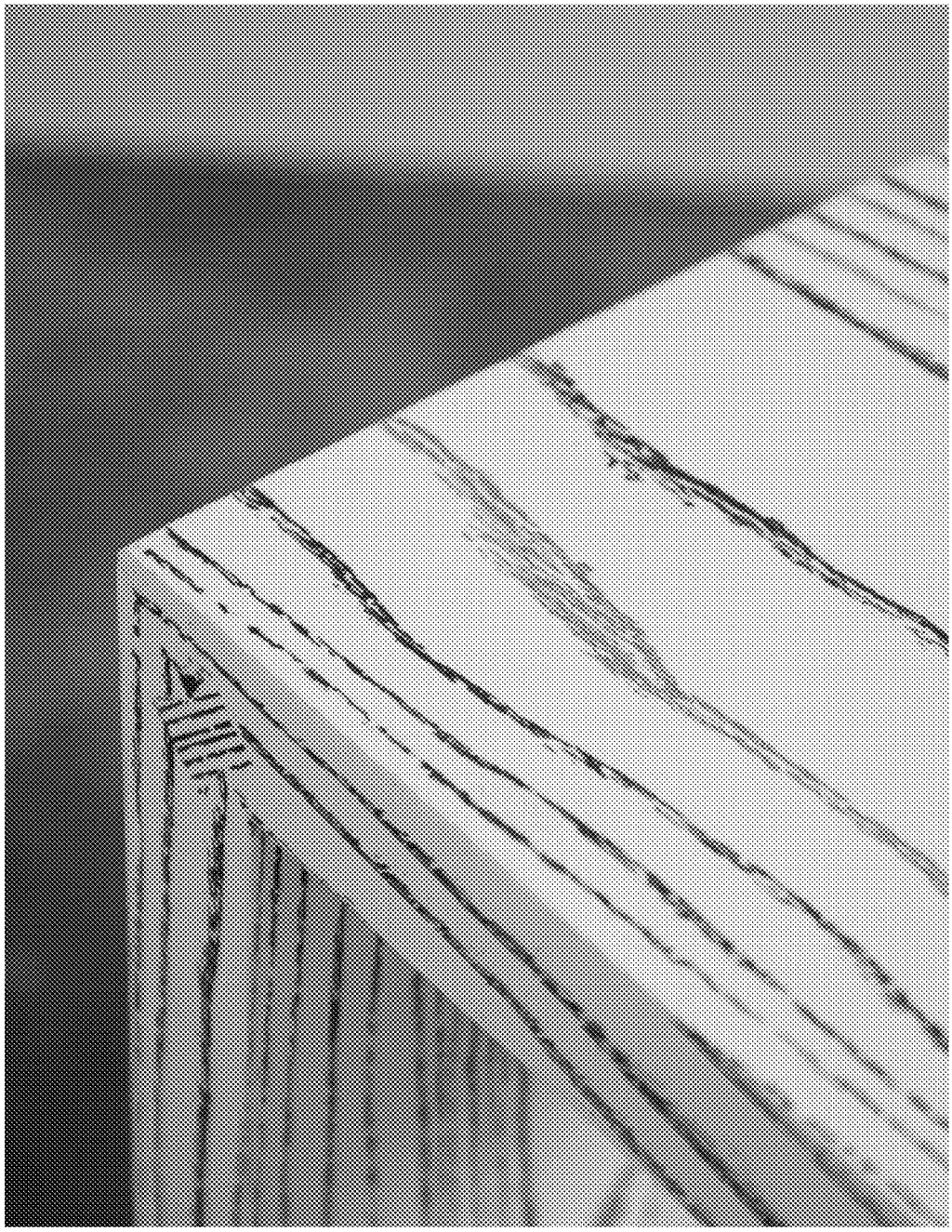
FIG. 8 is a photograph of a piece of furniture with a white base paint and black glaze or second paint in the grains of the workpiece, the view showing one accent grain colored in a different color than the other grains, in this example, the color being yellow.
Figure 9:
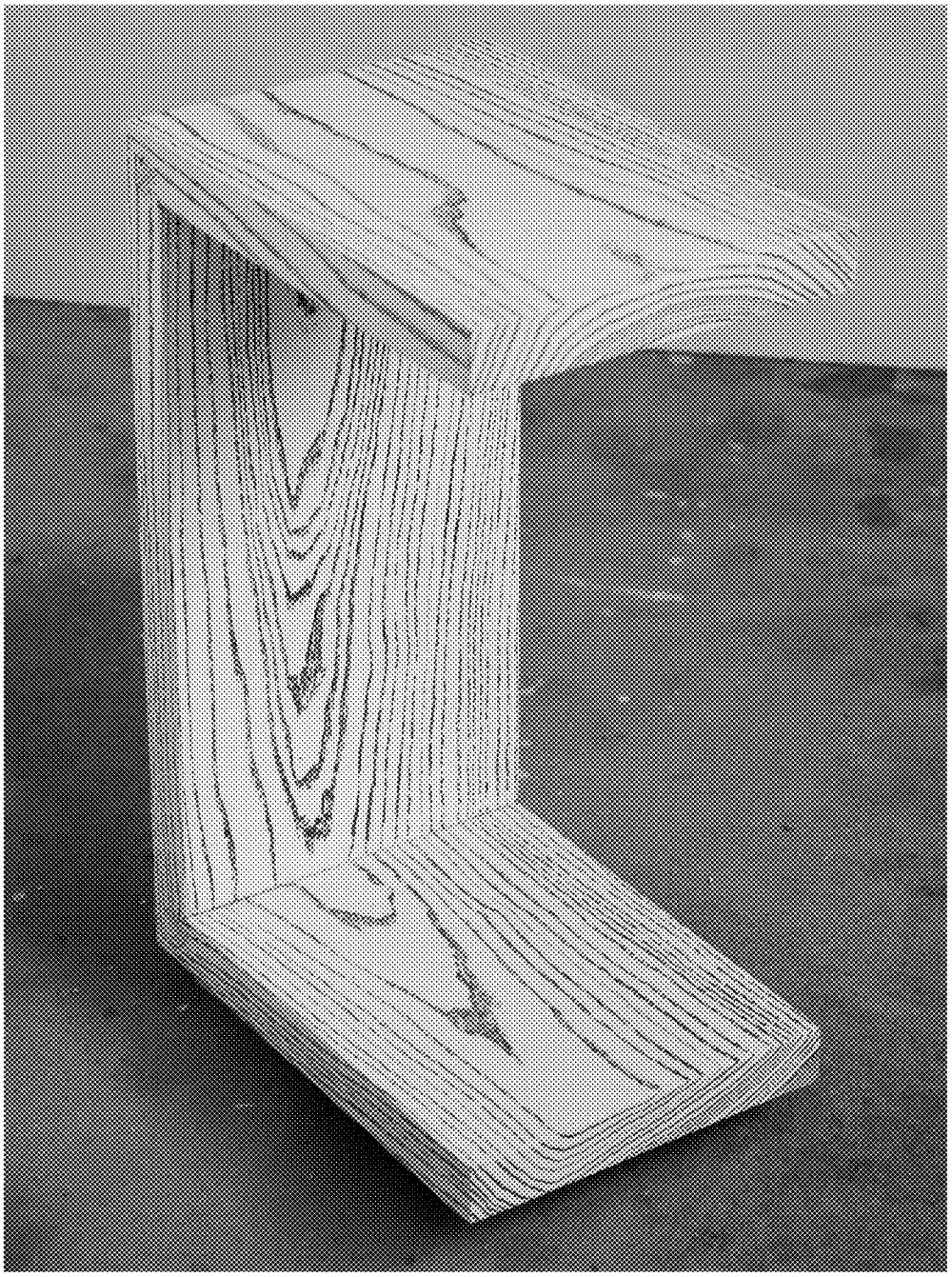
FIG. 9 is another photograph of the piece of furniture shown in FIG. 8 with a white base paint and black glaze or second paint in the grains of the workpiece, the view showing one accent grain colored in a different color than the other grains, in this example, the color being yellow.

In one arrangement, different strands of grain may be filled or painted separately using the squeegee. That is, one grain may be coated with one color of glaze or second paint 1030 while adjacent grains may be coated with different colors. This arrangement provides a finished product where different grains are different colors. As one example, in one arrangement, the base paint 1010 is a black color and one grain is painted with a glaze or second paint 1030 that is a yellow or red color while all the other grains are painted with a glaze or second paint 1030 that is white, thereby giving the workpiece 1000 a truly one of a kind and unique look. An example of this is presented in FIGS. 8 and 9, wherein the base paint 1010 is white, most of the grains are in a glaze or second paint 1030 that is black and one grain is in a glaze or second paint 1030 that is yellow—giving this piece of furniture a unique appearance.

Figure 2E:
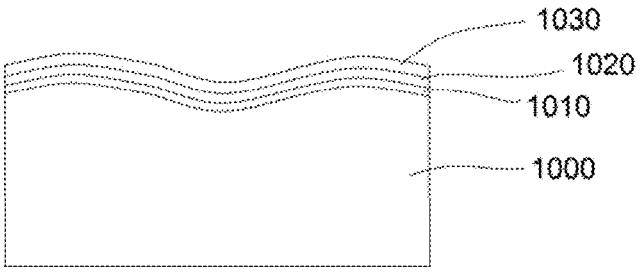
FIG. 2E is a view of the grained workpiece with a glaze or a paint applied thereto in accordance with example embodiments.
Figure 4E:
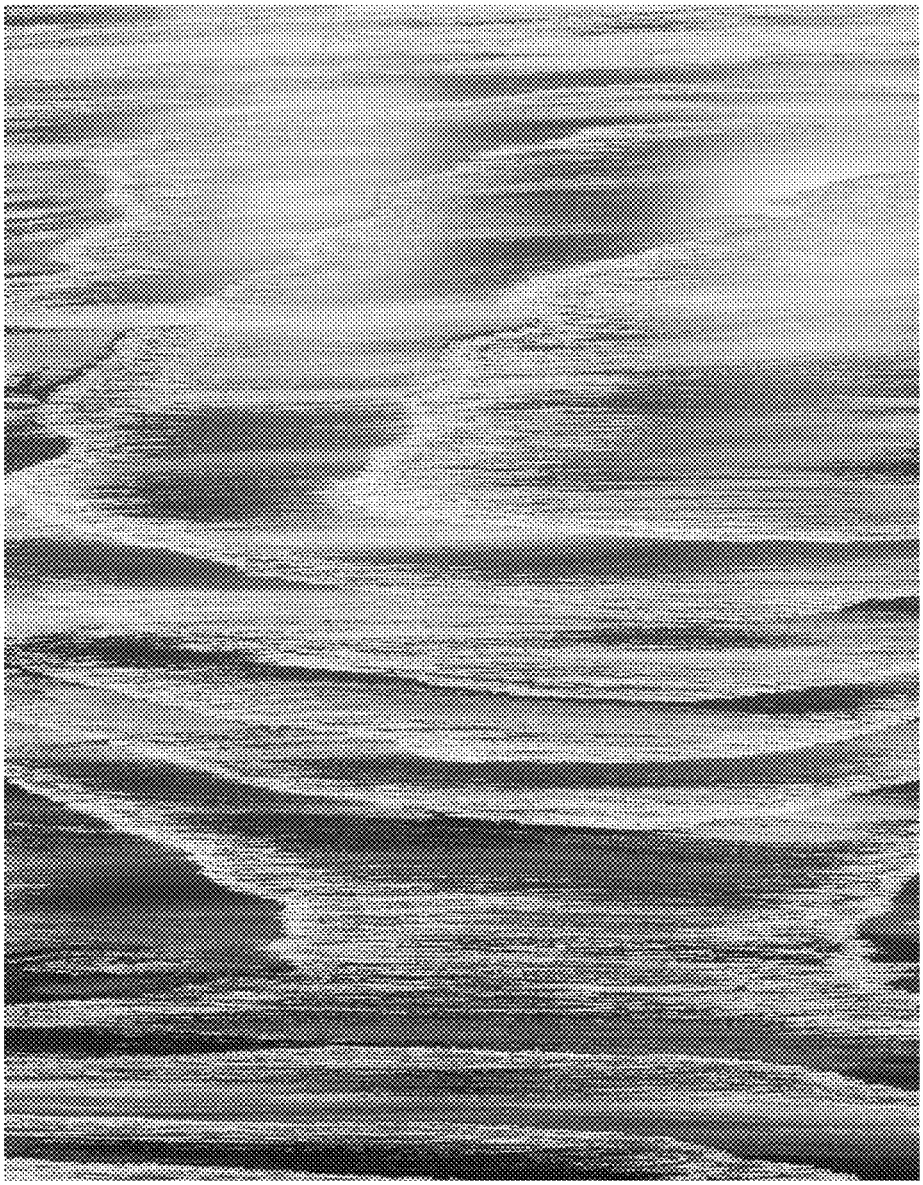
FIG. 4E is a photograph of the grained workpiece with a glaze or a second paint applied over the at least one clear coat which is applied over the base paint thereto in accordance with example embodiments.

As one demonstrative example, FIG. 2E shows a schematic view of the workpiece 1000 having a glaze or second paint 1030 thereon over the clear coat 102 which is over the base paint 1010. FIG. 4E is a photograph of a piece of wood having a glaze or second paint 1030 that is white over the clear coat 1020 that is clear which is over the base paint 1010 that is black.

In one arrangement, base paint 1010 and glaze or second paint 1030 may be formed of different materials, or different kinds of paint. In another arrangement, base paint 1010 and glaze or second paint 1030 may be formed of the same or similar materials, or the same kinds of paint, albeit of different colors or pigments.

Figure 2F:
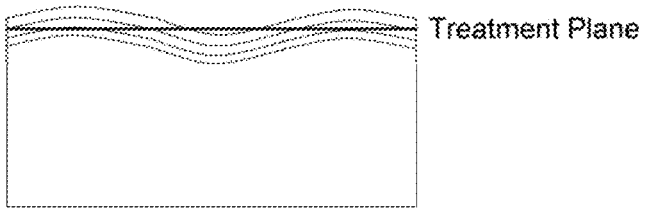
FIG. 2F is a view of the grained workpiece illustrating a surface treatment line in accordance with example embodiments.
Figure 2G:
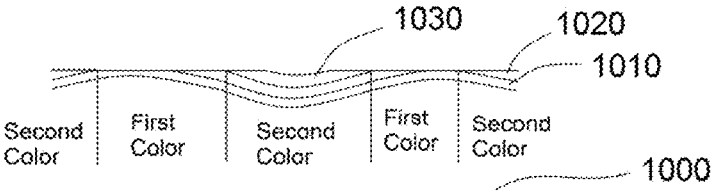
FIG. 2G is a view of the grained workpiece after a surface treatment in accordance with example embodiments.
Figure 2H:
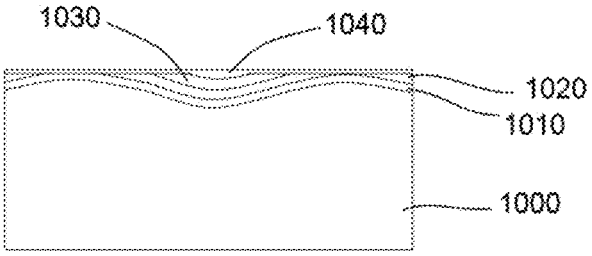
FIG. 2H is a view of the grained workpiece with at least one clear coat thereon in accordance with example embodiments.

STEP 600—SURFACE TREATMENT: After application of the glaze or second paint 1030 of operation 500, the glaze or second paint 1030 may be allowed to dry. After drying, the glaze or second paint 1030 may be subject to a surface treatment to expose the grains (see operation 600). For example, in one nonlimiting example embodiment, the glaze or second paint 1030 applied in operation 500 may be allowed to dry and then sanded to reveal the grains. FIG. 2F, for example, illustrates a treatment plane representing a plane upon which material above it is removed via the surface treatment of step 600 while the material below it remains. This treatment plane could be moved up so as to not intersect the first color of base paint 1010 and instead only intersect clear coat 1020 and glaze or second paint 1030, this depends upon the thickness of the layers, the depth of the recesses of the grains, and the amount of sanding, among other factors. FIG. 2G, for example, illustrates the colors observable to a user (when viewing in a direction perpendicular to the exasperated surface 1005). As shown in FIG. 2G, for example, each of the first and second colors are observable.

Figure 4F:
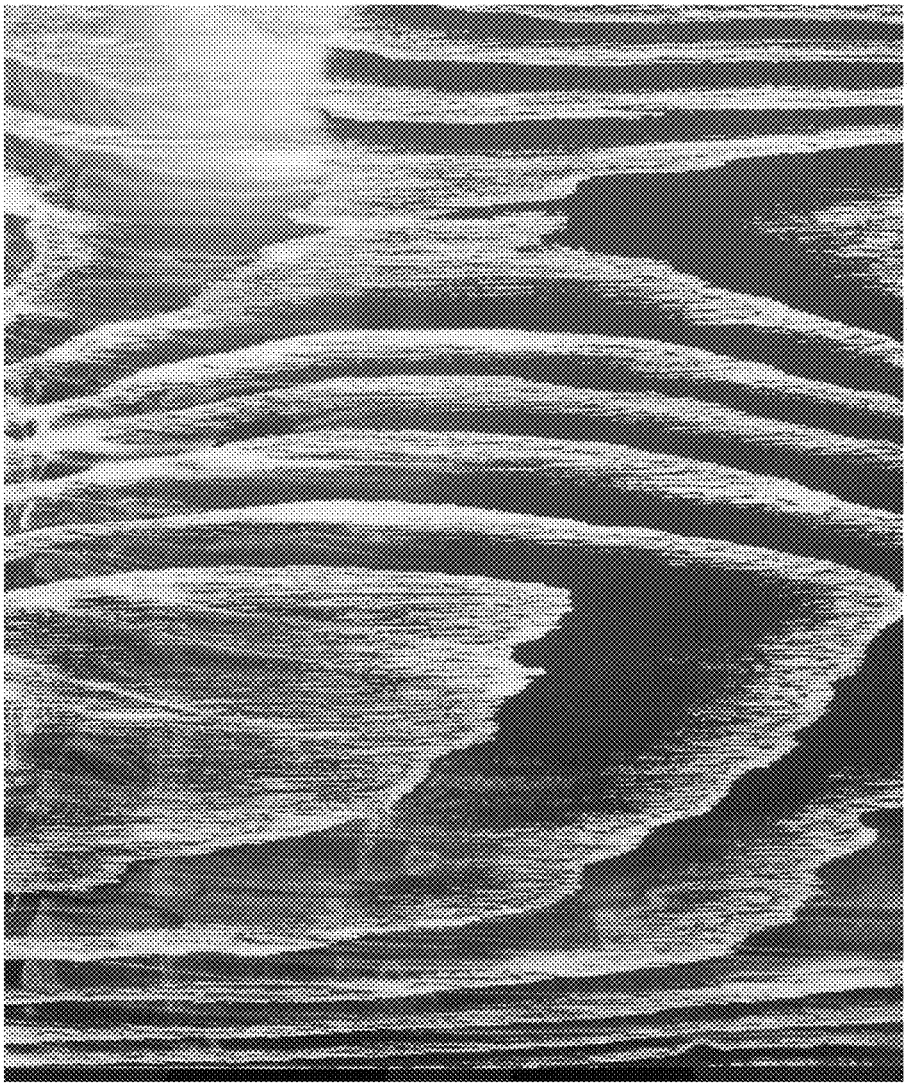
FIG. 4F is a photograph of the grained workpiece after a surface treatment is performed on the upper right side of the workpiece which leaves only the glaze or second paint in the recessed (opened) grains, the lower and left side of the workpiece has not had the surface treatment performed, in accordance with example embodiments.

FIG. 4F is photograph of a piece of wood having operations 100, 200, 300, 400, 500, 500, and 600 (in-part) performed on it. In this FIG. 4F, the left side of the picture has not been treated with the surface treatment of step 600 whereas the right side of the picture has been treated with the surface treatment step 600. As such, as is seen in FIG. 4F, in the left side of the picture, the non-grained portion of the workpiece 1000 includes some areas covered by the glaze or second paint 1030, whereas in the right side of the picture, the non-grained portion of the workpiece 1000 has been cleared of the glaze or second paint 1030 thereby leaving only the stark contrast between the non-grained portion having only first paint 1010, and the grained portion having glaze or second paint 1030 in the grains.

Figure 4G:
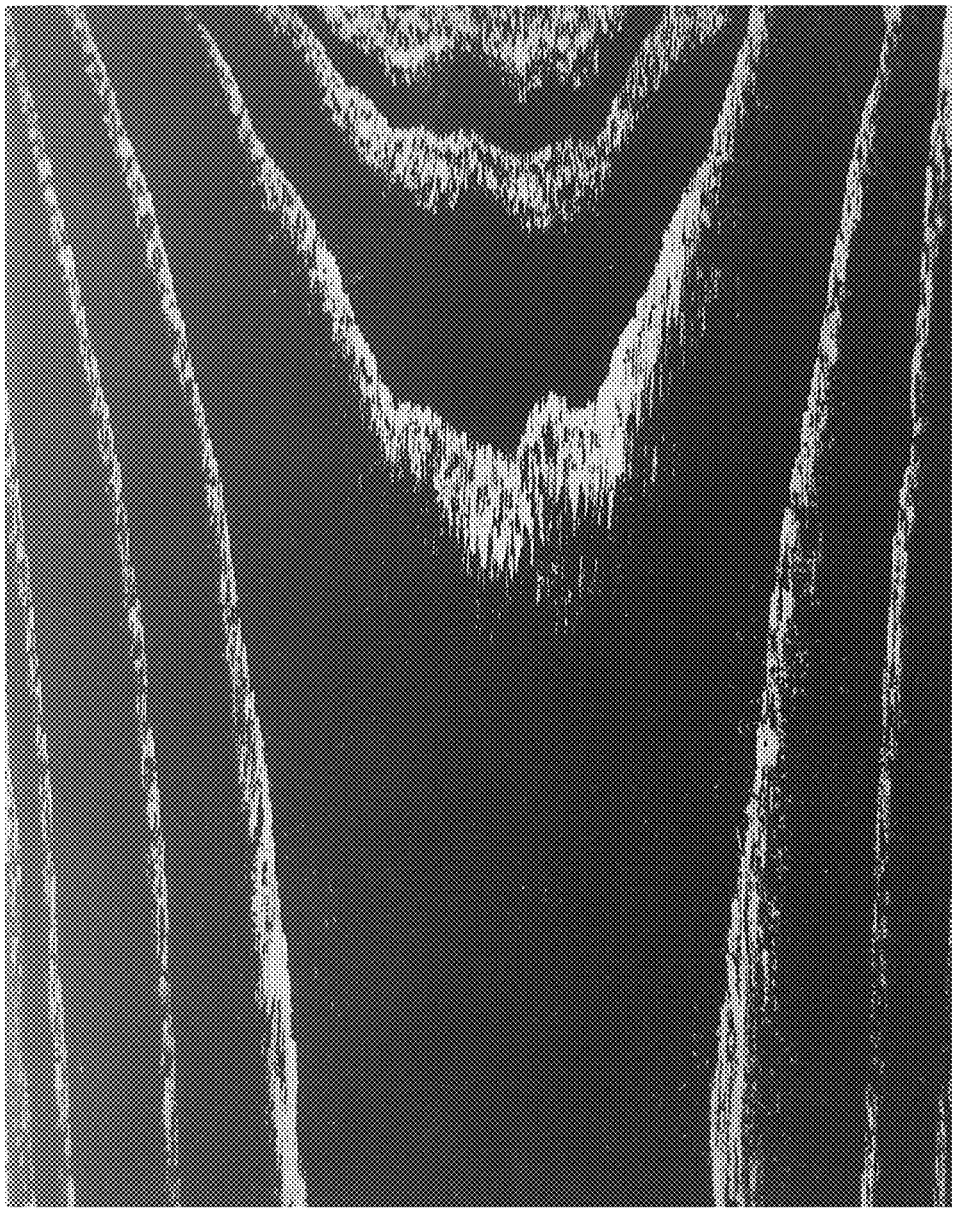
FIG. 4G is a photograph of the grained workpiece after a surface treatment is performed on the workpiece which leaves only the glaze or second paint in the recessed (opened) grains with at least one clear coat applied thereon in accordance with example embodiments.

FIG. 4G illustrates the completed workpiece 1000 having operation 600 performed on it. This picture reveals the stark contrast between the non-grained portion having only first paint 1010 (which in this example is black), and the grained portion having glaze or second paint 1030 in the grains (which in this example is white).

STEP 700—CLEAR COAT/SEALING LAYER: Once the excess glaze or second paint 1030 is removed, leaving only the glaze or second paint 1030 in the recesses or aberrations of the exasperated grains of workpiece 100, at least one clear coat 1040 may be applied to protect the grained workpiece 1000 (see FIG. 1, operation 700). The clear coat layer 1040 may be the same as or similar to clear coat 1020 and therefore reference is made to those portions of this application. More specifically, by way of example only, conversion varnish or oil based clear layers may be applied. Alternatively, water based clear layers may be applied. The advantage of this latter option is that it reduces a harmful impact to the environment. Any other clear, transparent, translucent or otherwise see-through coating is hereby contemplated for use. One layer of clear coat 1040 may be used, or alternatively two, three or more layers may be used and sanding may be performed between the layers in the manner described herein.

Figure 7:
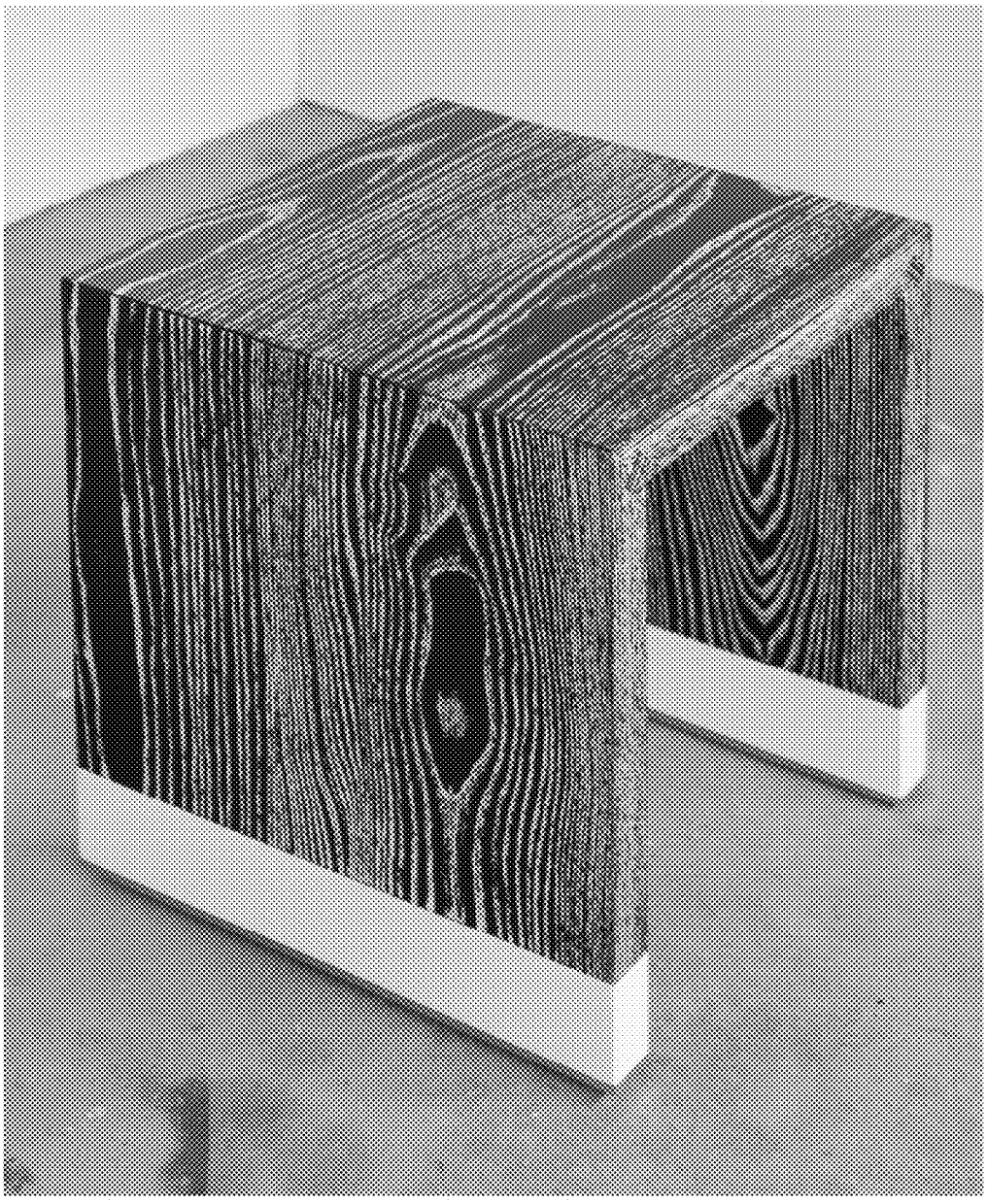
FIG. 7 is a photograph of a piece of furniture with a waterfall edge showing a continuous grain pattern that extends across the top of the piece of furniture and down the side in a relatively seamless manner.

SHEETS OF MATERIAL OR FURNITURE: It is understood that one skilled in the art may implement method 900 in wood used for furniture. For example, wood provided as large sheets may have their surfaces treated by the method of FIG. 1 and the wood may be cut and used as table tops, tops or sides or dressers, or even used in dresser drawers. Furthermore, the method may be useable in furniture having waterfall edges, wherein the grain continues in a continuous manner from one surface (such as a horizontal surface) to another surface (such as a vertical surface) providing a unique and desirable appearance. An example of a piece of furniture having a waterfall edge is shown in FIG. 7. In this example, the waterfall edges may be treated by the method of FIG. 1 to bring out the grains of wood present therein on multiple surfaces. In addition it is understood that the method of FIG. 1 is usable for not only flat surfaces but for rounded or curved surfaces as well. For example, FIGS. 3A-3G illustrate the method 900 of FIG. 1 applied to a wooden workpiece 1000 having a curved edge. As shown in FIGS. 3A-3G, the grains in the wood of the workpiece both in the curved portion and the flat portion are easily visible after application of method 900 to the workpiece 1000 illustrated therein. Due to the similarity of FIGS. 3A-3G to FIGS. 2A-2H a detailed discussion thereof is omitted for the sake of brevity.

Figure 5A:
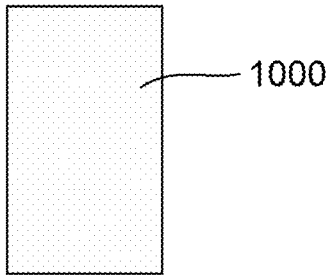
FIG. 5A illustrates a grained sheet in accordance with example embodiments.
Figure 5B:
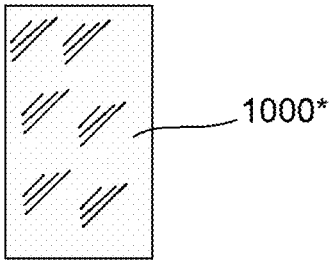
FIG. 5B illustrates the grained sheet with a surface exasperated in accordance with example embodiments.
Figure 5C:
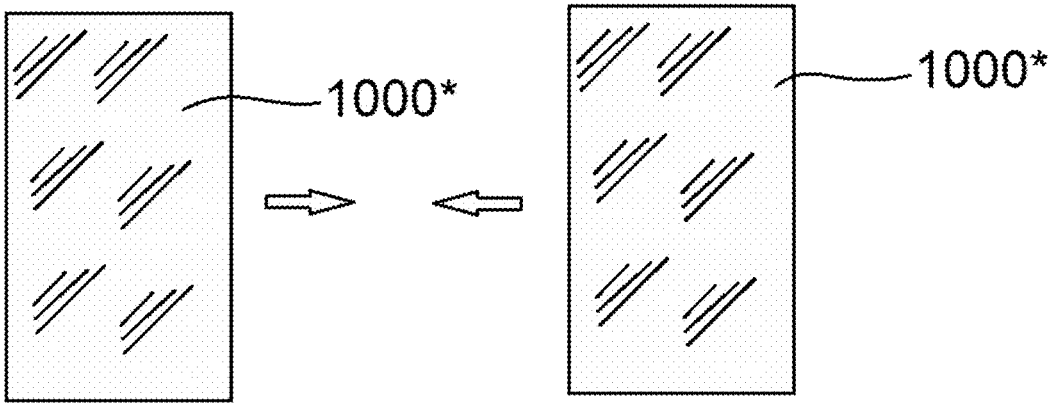
FIG. 5C illustrates two grained sheets having surfaces exasperated in accordance with example embodiments.
Figure 5D:
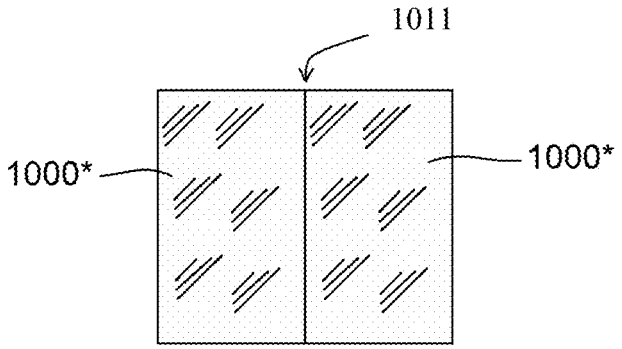
FIG. 5D illustrates the grained sheets joined together to form a large sheet in accordance with example embodiments.
Figure 5E:
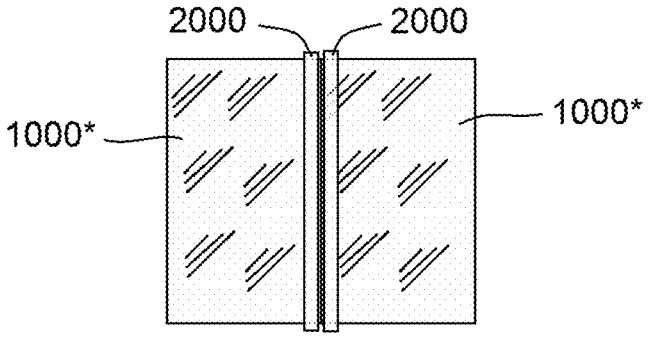
FIG. 5E illustrates grained sheets joined together and prepared for a filler in accordance with example embodiments.
Figure 5F:
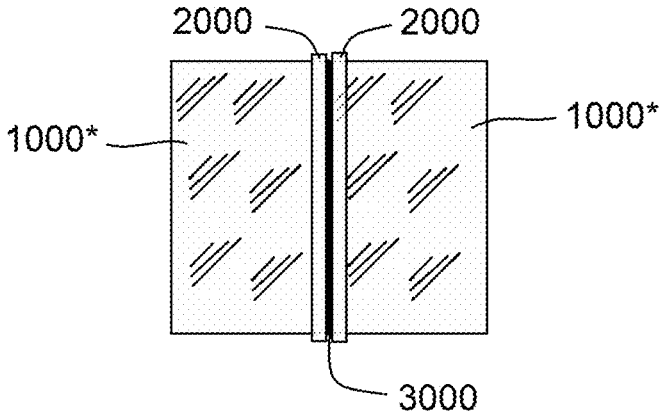
FIG. 5F illustrates grained sheets joined together with a filler applied thereto in accordance with example embodiments.
Figure 6A:
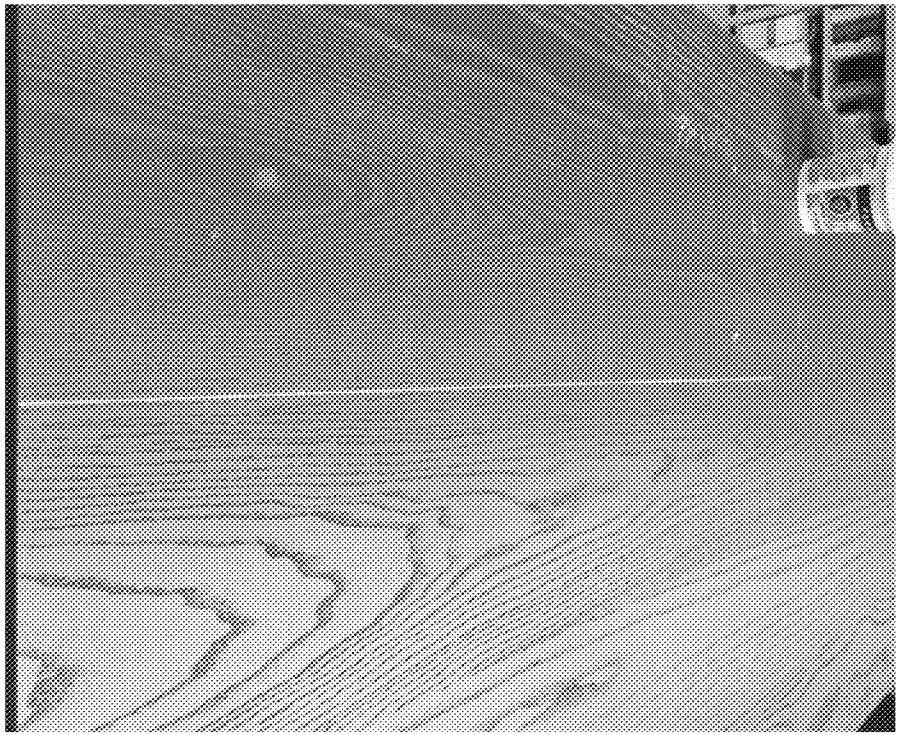
FIG. 6A is a photograph of the grained workpiece formed of two sheets of material or two boards that are joined together at a seam line, the view showing the workpieces after the grains have exasperated, after the base coat of paint has been applied, the view showing a filler being used to fill in the seam line between the two workpieces in accordance with example embodiments.
Figure 6B:
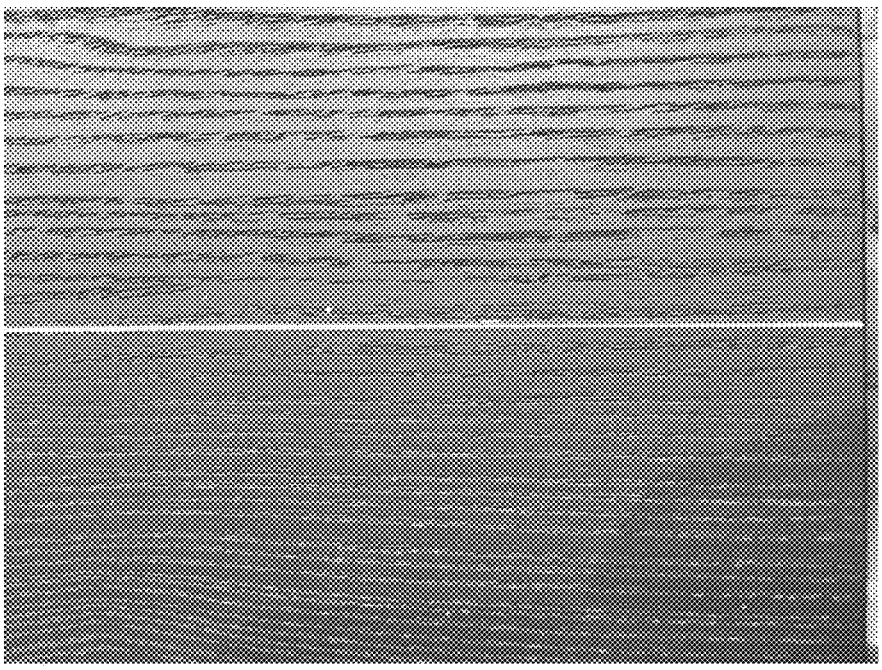
FIG. 6B illustrates a close-up of the seam line shown in FIG. 6A in accordance with example embodiments.
Figure 6C:
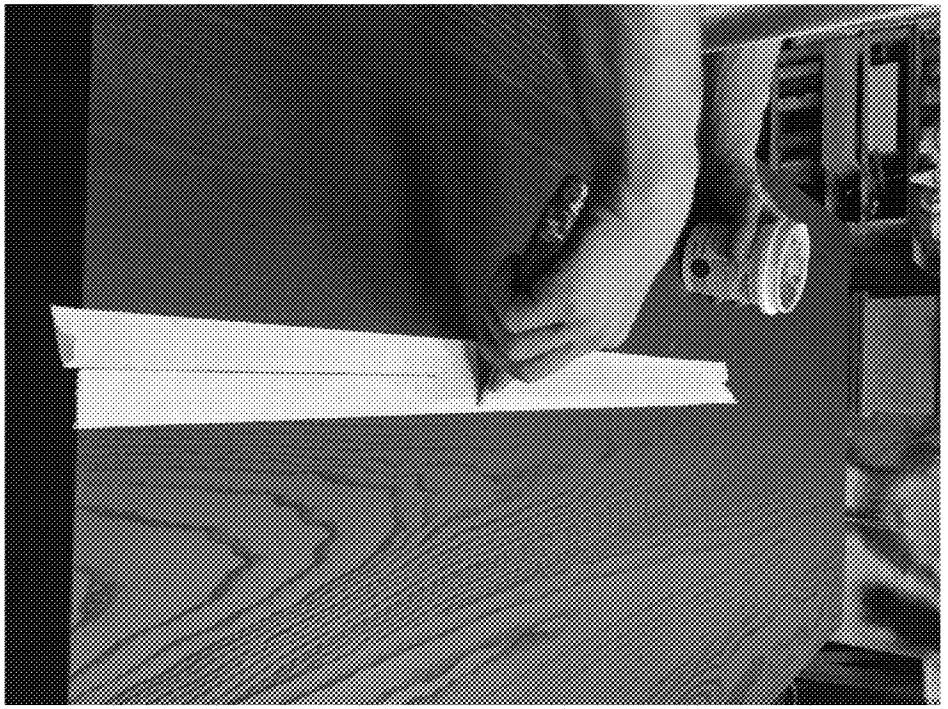
FIG. 6C illustrates the seam line shown in FIGS. 6A and 6B receiving a filler in accordance with example embodiments.
Figure 6D:
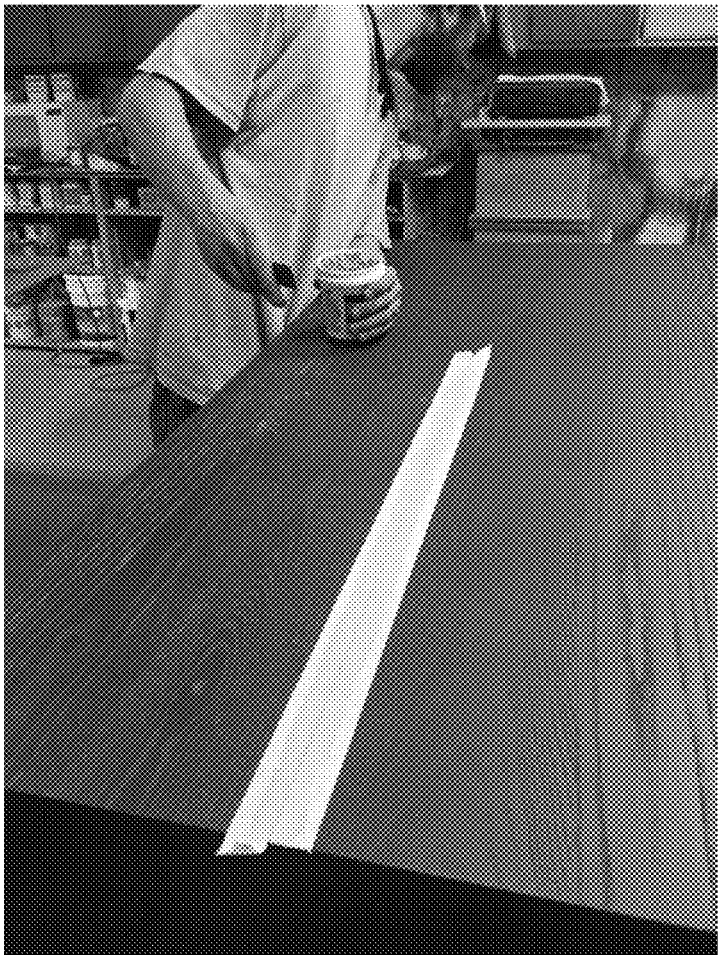
FIG. 6D is another view of the seamline of FIGS. 6A, 6B and 6C receiving filler applied in accordance with example embodiments.

FIGS. 5A-G illustrate a method of forming a large sheet or plane of material having the characteristics of the previously described treated workpieces 1000 that is formed of multiple pieces. FIG. 5A illustrates an example of a wood sheet 1000, for example, plywood. FIG. 5B illustrates the wood sheet 1000* after the exasperation process 200 of method 900. FIG. 5C illustrates two sheet type workpieces 1000* each having an exasperated surface. FIG. 5D shows the workpieces 1000* joined together. The workpieces 1000* may be joined together by mechanical fasteners and/or an adhesive. The workpieces 1000*, after being joined together, may be subject to operations 300-700 as described earlier. The inventor has noticed, at times, the fit-up between the two pieces 1000* may be improper which leaves a streak in the finished product. To compensate for this, the inventor has developed an extra step where a filler material is applied to the interface 1011 between the workpieces 1000*. In one embodiment, two pieces of tape 2000 are laid down on either side of the interface 1011 with a small gap between pieces of tape 2000. The filler 3000 may then be applied to the gap between the pieces of tap 2000 to cover the interface 1011. The tape 2000 may then be removed and operations 300 to 700 of method 900 may be performed on the composite structure. In the alternative, the tape 2000 and filler 3000 may be applied after a base paint is applied to the composite structure (operation 300) but before the clear coat is applied (operation 400). FIG. 6A illustrates a photograph showing a white line where a fit-up between two workpieces was improper and FIG. 6B illustrates a close-up of the white line. FIGS. 6C and 6D illustrate an artisan applying the method illustrated in FIGS. 5E and 5F to cure the defective seam.

Figure 10:
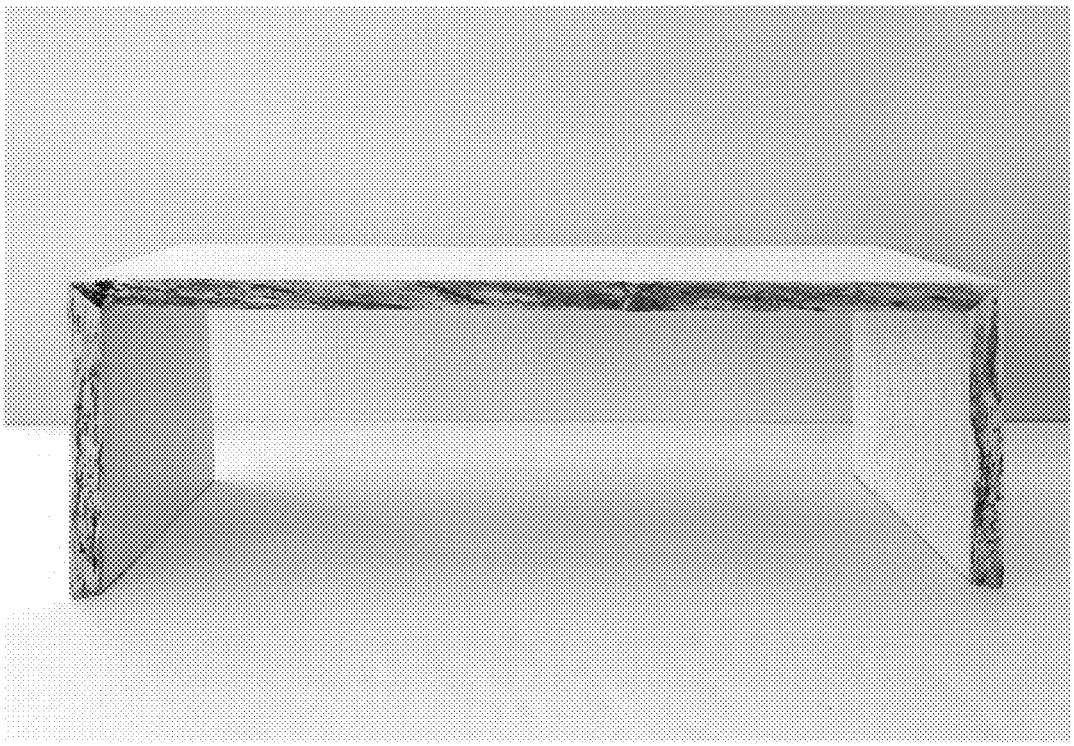
FIG. 10 is a photograph of a piece of furniture with the upper/outer and lower/inner surfaces treated with grain exasperation process presented herein, the furniture having a white base paint and tan glaze or second paint in the grains of the workpiece, the view showing the edges of the workpiece having an un-treated live edge, which shows that the workpiece is a real piece of wood.

LIVE EDGE: In one example, with reference to FIG. 10, a workpiece 1000 having a flat opposing surfaces that are treated with the method of FIG. 1 is presented and has a live edge. The live edge is an untreated, rough and natural edge of the plank of wood that the furniture is formed of. That is, the live edge of the workpiece is not flat and machined. Instead, the live edge takes the undulating and unique shape of the tree's exterior edge. Alternatively, the live edge is a weathered or worn edge that is not flat and instead takes the natural contours of the piece of reclaimed wood. This unique appearance, of a live edge that connects to a machined surface with the process described herein, provides a stark contrast of the upper and lower (or outer and inner) surfaces that are treated with the surface treatment of FIG. 1, while showing a live edge or natural edge, which reveals to the viewer that this is a natural piece of wood or material. This provides a very stunning appearance that draws substantial attention due to its contrast and conflict.

Alternative Arrangement and/or Additional Step—Wiping Glaze:

One problem associated with the process described herein is that, especially when a base paint of a first color 1010 is used that is black or dark in color and a glaze or second paint 1030 is used that is white or light, it is difficult to see whether all of the glaze or second paint 1030 that is white or light in color has been removed in the flat or non-grained parts of the grained workpiece 1000. In one arrangement, an additional step is performed after the glaze or second paint 1030 is added at step 500 and before the surface treatment (which is sanding, buffing, or the like) is performed at step 600. This step is step 550, which is wiping with an absorbent device, such as a damp cloth. Step 550, wiping with an absorbent device, such as a damp cloth may occur either: before the glaze or second paint 1030 dries, after glaze or second paint 1030 fully dries, or after the glaze or second paint 1030 partially dries.

In one arrangement, step 550, wiping with an absorbent device, such as a damp cloth occurs before the glaze or second paint 1030 dries. In this arrangement, after the grains of workpiece 1000 has been exasperated at step 200, and the base paint of a first color 1010 has been applied at step 300 and allowed to dry, and a clear coat 1020 has been applied at step 400 and allowed to dry, a glaze or second paint 1030 is added at step 500. During this step, the glaze or second paint 1030 is worked into the recesses in the grains of the grained workpiece 1000 using a mechanical action such as brushing, squeegeeing or the like. However, some of the glaze or second paint 1030 inevitably remains on the flat and/or non-grained portions of the grained workpiece 1000. If left in these areas, this provides a hazy look to the resulting workpiece 1000 which is undesirable. If the glaze or second paint 1030 is allowed to dry in these areas it must be removed in the surface treatment step, step 600, to provide the stunning contrast between the grained and non-grained portions of the grained workpiece 1000. However, getting all of the glaze or second paint 1030 removed can be challenging, especially without sanding through the clear coat layer 1020 and/or the base paint of a first color 1010. In addition, it can be challenging when the surface of the workpiece 1000 is not flat. To reduce this residual amount of glaze or second paint 1030 on the non-grained or flat portions of the grained workpiece an absorbent device, such as a damp cloth is wiped over the surface of the grained workpiece 1000. Any other mechanical action is hereby contemplated for use and may be used such as rubbing, buffing, brushing, rolling or the like. Any other device may be used that removes the glaze or second paint 1030 such as a roller, a brush, a towel, a rag, a pad, or the like. By wiping an absorbent device, such as a damp cloth, over the surface of the workpiece 1000 while the glaze or second paint 1030 is still wet helps to facilitate the removal of the glaze or second paint 1030 from the surface of the workpiece 1000. This helps to remove the glaze or second paint 1030 from the flat portions of the workpiece 1000, while leaving the glaze or second paint 1030 in the recessed grains of the workpiece 1000. This means that substantially less, if any, glaze or second paint 1030 must be removed from the flat portions of the workpiece 1000. This means that less surface treatment is required at step 600, this means that less glaze or second paint 1030 is left behind after step 600, this means that the resulting surface finish from the process is cleaner, crisper, bolder and has more contrast than if the wiping step 550 was performed. This also means that the overall surface treatment process is easier to perform as less surface treatment 600 is needed as less residual glaze or second paint 1030 must be removed. In one arrangement, the chemistry and/or viscosity of the glaze or second paint is modified to ensure it has the proper properties for wet removal. In one arrangement, the glaze or second paint 1030 is thinned by adding water or another diluent, which again, helps to remove the glaze or second paint where it is not desired. In one arrangement, using a damp cloth, or a damp absorbent device such as a sponge, rag, towel, cloth or the like helps to both wipe the surface clean as well as absorb the glaze or second paint 1030. In one arrangement, one wiping process is performed. In another arrangement, two, three, four or more wiping processes are performed. By wiping before the glaze or second paint 1030 dries, this allows for quick, easy and simple removal prior to the glaze or second paint 1030 binding to the at least one clear coat 1020. A solvent may also be used to help removal of the glaze or second paint 1030, as is described below.

In one arrangement, step 550, wiping with an absorbent device, such as a damp cloth, occurs after the glaze or second paint 1030 fully dries. In this arrangement, the process described above is repeated, however the glaze or second paint 1030 is given ample time to fully dry. By allowing the glaze or second paint 1030 time to dry, allows the glaze or second paint 1030 to harden and bind to the at least one clear coat 1020. In this arrangement, wiping the glaze or second paint 1030 off of the flat surfaces requires additional effort, due to the glaze or second paint 1030 having dried as opposed to the glaze or second paint 1030 being wet as is described above. In one arrangement, a solvent is used on absorbent device to help dissolve the glaze or second paint 1030. In one arrangement, the glaze or second paint 1030 is water soluble and the absorbent device is moistened with water, as such when the workpiece is wiped, the water in the absorbent device dissolves and removes the glaze or second paint 1030, especially on the flat surfaces of the workpiece 1000. Other solvents that may be used, with the corresponding glaze or second paint 1030 may include: water, alcohol, Mineral spirits (US)/White spirit (UK), Acetone, Turpentine, Naphtha, Toluene, Methyl ethyl ketone (MEK), Dimethylformamide (DMF), 2-Butoxyethanol, or any of the other glycol ethers, or the like, or any combination thereof is hereby contemplated for use. In this arrangement, as the surface of the workpiece 1000 is wiped, the mechanical action along with the chemical action of the solvent helps to remove the undesired glaze or second paint 1030 in the flat portions of the workpiece 1000 while leaving the glaze or second paint 1030 in the recesses of the grains.

In one arrangement, step 550, wiping with a damp cloth occurs after the glaze or second paint 1030 partially dries, and/or before the glaze or second paint 1030 fully dries. In this arrangement, either or a combination of the processes described above with wiping the glaze or second paint 1030 when wet or dry may be used. Wiping when the glaze or second paint 1030 is partially dry provides some benefits as some portions of the glaze or second paint 1030 has dried and is difficult to remove, such as glaze or second paint 1030 in the recesses of the grains, while other portions of the glaze or second paint 1030 remain wet and may be easily removed. As such, with the proper chemistry and viscosity of the glaze or second paint 1030 and the proper solvent, as well as the proper physical characteristics of the absorbent device, this arrangement may perform better than removal while fully wet or fully dry.

As is described herein, attempted removal of the glaze or second paint 1030 from the flat surfaces of the workpiece 1000 using an absorbent device, and/or a solvent, provides many advantages.

Example embodiments of the disclosure have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present disclosure may be practiced otherwise than as specifically described.

What I claim is:

1. A method of treating a piece of grained material, the steps comprising:

providing a piece of grained material having a top surface, a first side surface, a second side surface and a bottom surface, wherein the top surface has a grain pattern;

preparing the top surface of the piece of grained material by sand blasting;

applying a first layer of base paint of a first color;

allowing the first layer of base paint of the first color to dry;

sanding the first layer of base paint of the first color after it dries;

applying a second layer of base paint of the first color onto the first layer of base paint of the first color after it dries and is sanded;

allowing the second layer of the base paint of the first color to dry;

sanding the second layer of the base paint of the first color after it dries;

applying a first layer of clear coat on the base paint;

allowing the first layer of clear coat to dry; sanding the first layer of clear coat after it dries;

applying a second layer of clear coat onto the first layer of clear coat after it dries and is sanded;

allowing the second layer of clear coat to dry; sanding the second layer of clear coat after it dries;

applying a first layer of a second paint of a second color on the clear coat;

working the first layer of the second paint of the second color into recessed surface contours of the grains of the piece of grained material; allowing the first layer of the second paint of the second color to dry;

sanding the first layer of the second paint of the second color after it dries such that the first layer of the second paint of the second color remains in the recessed surface contours of the grains of the piece of grained material but is removed from areas above the recessed surface contours of the grains of the piece of grained material;

applying a first layer of top coat on the second paint of a second color after it dries and is sanded; allowing the first layer of the top coat to dry;

sanding the first layer of top coat after it dries;

applying a second layer of the top coat on the first layer of top coat after it dries and is sanded.

2. The method of claim 1, wherein the piece of grained material is a piece of wood.

3. The method of claim 1, wherein the piece of grained material is a plank of wood having live edges.

4. The method of claim 1, wherein the piece of grained material is a piece of plywood.

5. The method of claim 1, wherein sand blasting opens grains in the grain pattern.

6. The method of claim 1, wherein the base paint of the first color is selected from the group consisting of: a primer, a sealer, an acrylic matte paint, an acrylic eggshell paint, an acrylic satin paint, an acrylic semi-gloss paint, an acrylic gloss paint, an alkyd matte paint, an alkyd eggshell paint, an alkyd satin paint, an alkyd semi-gloss paint, an alkyd gloss paint, a water based paint, an oil based paint, and a latex paint.

7. The method of claim 1, wherein sanding of the base paint of a first color is performed using a high-grit sand paper.

8. The method of claim 1, further comprising the steps of:

applying a third layer of base paint of the first color onto the second layer of base paint of the first color after it dries and is sanded;

allowing the third layer of the base paint of the first color to dry;

sanding the third layer of the base paint of the first color after it dries.

9. The method of claim 1, wherein sanding of the clear coat is performed using a high-grit sand paper.

10. The method of claim 1, wherein the clear coat is selected from the group consisting of: a varnish, a resin, shellac, an alkyd, a spar varnish, a drying oil, a polyurethane, a lacquer, and an acrylic.

11. The method of claim 1, wherein the second paint of the second color is selected from the group consisting of: a glaze, a primer, a sealer, an acrylic matte paint, an acrylic eggshell paint, an acrylic satin paint, an acrylic semi-gloss paint, an acrylic gloss paint, an alkyd matte paint, an alkyd eggshell paint, an alkyd satin paint, an alkyd semi-gloss paint, an alkyd gloss paint, a water based paint, an oil based paint, and a latex paint.

12. The method of claim 1, wherein the second paint of the second color is worked into surface contours of the piece of grained material by squeegeeing, wiping, rubbing, brushing or rolling the second paint of the second color into the recessed surface contours of the grains of the piece of grained material.

13. The method of claim 1, further comprising the step of applying a second layer of the second paint after the first layer of the second paint dries and is sanded;

allowing the second layer of the second paint of the second color to dry;

sanding the second layer of the second paint of the second color after it dries.

14. The method of claim 1, wherein the top coat is selected from the group consisting of: a varnish, a resin, shellac, an alkyd, a spar varnish, a drying oil, a polyurethane, a lacquer, and an acrylic.

15. The method of claim 1, wherein the top coat is clear.

16. A method of treating a piece of grained material, the steps comprising:

providing a piece of grained material having a top surface, a first side surface, a second side surface and a bottom surface, wherein the top surface has a grain pattern;

preparing the top surface of the piece of grained material by sand blasting;

applying a first layer of base paint of a first color;

allowing the first layer of base paint of the first color to dry;

sanding the first layer of base paint of the first color after it dries;

applying a first layer of clear coat on the base paint;

allowing the first layer of clear coat to dry;

sanding the first layer of clear coat after it dries;

applying a first layer of a second paint of a second color on the clear coat;

working the first layer of the second paint of the second color into recessed surface contours of the grains of the piece of grained material;

allowing the first layer of the second paint of the second color to dry;

sanding the first layer of the second paint of the second color after it dries such that the first layer of the second paint of the second color remains in the recessed surface contours of the grains of the piece of grained material but is removed from areas above the recessed surface contours of the grains of the piece of grained material;

applying a first layer of top coat on the second paint of a second color after it dries and is sanded.

* * * * *